US009679522B2

(12) United States Patent
Aggarwal et al.

(10) Patent No.: US 9,679,522 B2
(45) Date of Patent: Jun. 13, 2017

(54) FREQUENCY DOMAIN PROCESSING OF IMAGE USED TO DRIVE MULTI-PIXEL LIGHTING DEVICE OUTPUT

(71) Applicant: ABL IP HOLDING LLC, Conyers, GA (US)

(72) Inventors: Januk Aggarwal, Tysons Corner, VA (US); David P. Ramer, Reston, VA (US); Jack C. Rains, Jr., Herndon, VA (US)

(73) Assignee: ABL IP HOLDINGS LLC, Conyers, GA (US)

( * ) Notice: Subject to any disclaimer, the term of this patent is extended or adjusted under 35 U.S.C. 154(b) by 27 days.

(21) Appl. No.: 14/603,884

(22) Filed: Jan. 23, 2015

(65) Prior Publication Data

US 2016/0217749 A1 Jul. 28, 2016

(51) Int. Cl.

| | |
|---|---|
| ***G09G 3/34*** | (2006.01) |
| ***H05B 37/00*** | (2006.01) |
| *G09G 5/36* | (2006.01) |

(52) U.S. Cl.

CPC ..... *G09G 3/3406* (2013.01); *H05B 37/00* (2013.01); *G09G 5/36* (2013.01); *G09G 2340/06* (2013.01); *G09G 2370/022* (2013.01)

(58) Field of Classification Search

CPC .... G09G 3/3406; G09G 5/36; G09G 2340/06; G09G 2310/0243; G09G 2370/022

See application file for complete search history.

(56) References Cited

U.S. PATENT DOCUMENTS

| | | | | |
|---|---|---|---|---|
| 8,710,768 | B2 | 4/2014 | Rogers et al. | |
| 8,760,074 | B2 | 6/2014 | Raj et al. | |
| 8,779,669 | B2 | 7/2014 | Ramer et al. | |
| 2010/0182350 | A1* | 7/2010 | Fujine | G09G 5/00 345/690 |
| 2013/0077829 | A1* | 3/2013 | Cramblitt | G06T 5/10 382/104 |
| 2015/0339969 | A1* | 11/2015 | Gu | G09G 5/02 345/77 |

OTHER PUBLICATIONS

Fraunhofer-Gesellschaft, Sky light sky bright-in the office, Research News, Jan. 2012—Topic 1. Retrieved from http://www.fraunhofer.de/en/press/research-news/2012/january/sky-light-sky-bright.html.

Scott, K., Engineers create virtual sky for office ceilings, Technology, Jan. 2004. Retrieved from http://www.wired.co.uk/news/archive/2012-01/04/office-ceilings-made-to-mimic-the-sky.

* cited by examiner

*Primary Examiner* — Liliana Cerullo

(74) *Attorney, Agent, or Firm* — RatnerPrestia

(57) ABSTRACT

A lighting system uses a multi-pixel lighting matrix, for example, having an n by m pixel matrix of light emitters, to provide illumination from a ceiling or wall. Instead of using an actual image or video, which may be distracting, the examples in this case manipulate a frequency domain representation, for example, in Fourier transform space. The representation is transformed to real time image space, to drive the matrix of the lighting device. Manipulation in the frequency domain can maintain image characteristics suitable to an intended illumination application yet produce an output illumination image on the matrix that is less obviously an image of an object and less likely to draw unnecessary attention from an occupant of the illuminated space.

22 Claims, 10 Drawing Sheets

10

FREQUENCY DOMAIN PROCESSING OF IMAGE USED TO DRIVE MULTI-PIXEL LIGHTING DEVICE OUTPUT

TECHNICAL FIELD

The present subject matter relates to techniques and equipment to control a multi-pixel lighting device output based on an image that has been manipulated in the frequency domain, e.g. in Fourier transform space.

BACKGROUND

Electrical lighting has become commonplace in modern society. Electrical lighting devices are commonly deployed, for example, in homes and buildings of commercial and other enterprise establishments. Traditional general lighting devices have tended to be relatively dumb, in that they can be turned ON and OFF, and in some cases may be dimmed, usually in response to user activation of a relatively simple input device. Such lighting devices have also been controlled in response to ambient light detectors that turn on a light only when ambient light is at or below a threshold (e.g. as the sun goes down) and in response to occupancy sensors (e.g. to turn on light when a room is occupied and to turn the light off when the room is no longer occupied for some period). Often such devices are controlled individually or as relatively small groups at separate locations. Traditional control algorithms involved setting a condition or parameter of the light output, such as intensity and/or color and then maintaining the set condition within some minimal variance for a relatively long period of time, e.g. over a work day or a period occupancy. Often, the setting(s) would apply to most if not all sources emitting light into a particular illuminated space, for example, so that the illumination throughout the space would have a relatively uniform characteristic.

It has been recognized, however, that variation in lighting characteristics and/or variations over time may have desirable effects on occupants. Simulation of natural lighting, for example, may enhance performance of workers occupying the illuminated space. Other variations may produce adverse effects desired by an operator of the lighting device or system, for example, to encourage people not to linger too long in a particular area. There have been proposals and/or product offerings involving use of video displays as lighting devices mounted on ceilings or walls, where the lighting device displays are driven by image or video signals. In some cases, outside cameras capture video of outside conditions and the lighting devices display the videos to provide indoor illumination.

The Fraunhofer Institute has demonstrated a lighting system using luminous tiles, each having a matrix of red (R), green (G), blue (B) and white (W) light emitting diodes (LEDs) and a diffuser film. The LEDs of the system were driven to simulate or mimic the effects of clouds moving across the sky.

Such display or image simulation type lighting, however, can be distracting as occupants tend to look to the displayed or simulated images, for example, in response to apparent motion in the image.

For these or other reasons, there is room for still further improvement.

SUMMARY

A lighting system uses a multi-pixel lighting matrix, for example, to provide illumination from a ceiling or wall.

Instead of using an actual image or video to drive the matrix, which may be distracting, the examples disclosed in this specification manipulate a frequency domain representation, for example, in Fourier transform space, and use an image derived from an inverse transform of the manipulated frequency domain representation to drive the lighting matrix.

A disclosed method, for example, may involve obtaining a frequency domain data set corresponding to an image, and a processor manipulating at least one aspect of the frequency domain data set to form a manipulated frequency domain data set. The manipulated frequency domain data set is transformed into an image domain data set; and an image file is produced for controlling operation of a multi-pixel lighting device, based at least in part on the image domain data set.

The technology examples described below include a program product for implementing such a method as well as computers or other machines for implementing such a method. In some computer examples, the computer includes a communication interface and the programming enables the computer to transmit an image, based at least in part on the image domain data set, via the interface and through a communication network, to one or more multi-pixel lighting devices.

In other examples, a lighting system includes a pixel matrix of light emitters. Each light emitter at a respective pixel of the matrix includes a source of light configured to be controlled to vary a characteristic of light emitted from the respective pixel. A driver circuit is connected to the pixel matrix and is configured to control the light emitters at the pixels of the matrix in response to an image input. This type of system example also includes an image data processor that obtains a frequency domain data set corresponding to an image and manipulates at least one aspect of the frequency domain data set to form a manipulated frequency domain data set. The processor transforms the manipulated frequency domain data set into an image domain data set and supplies the image input for use by the driver circuit, based at least in part on the image domain data set.

Additional objects, advantages and novel features of the examples will be set forth in part in the description which follows, and in part will become apparent to those skilled in the art upon examination of the following and the accompanying drawings or may be learned by production or operation of the examples. The objects and advantages of the present subject matter may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

The various examples disclosed herein relate to a lighting device to provide lighting for an area based on imagery that may have characteristics desirable to an occupant of the area. The imagery is intended to provide the desirable effects of variation in lighting characteristics over the output surface of the lighting device analogous to a displayed still or moving image, but without such detailed imagery as might otherwise distract the area occupant. In other words, although capable of providing high resolution details, examples of the lighting device provide imagery a modified imagery that is a less exact representation of any particular image yet can maintain some or all of the desired lighting effects.

For example, manipulation of image characteristics in the frequency domain can maintain image characteristics suitable to an intended illumination application yet produce an output illumination image on the matrix that is less obviously an image of an object and less likely to draw unnecessary attention from an occupant of the illuminated space. In other words, the beneficial aspects of lighting variation is provided by manipulating frequency characteristics of an image without diminishing the necessary illumination requirements for the lighting device. For example, a business office setting may demand a minimum lighting requirement from a lighting device per Occupational Safety and Health Agency (OSHA) specifications.

Figure 1:
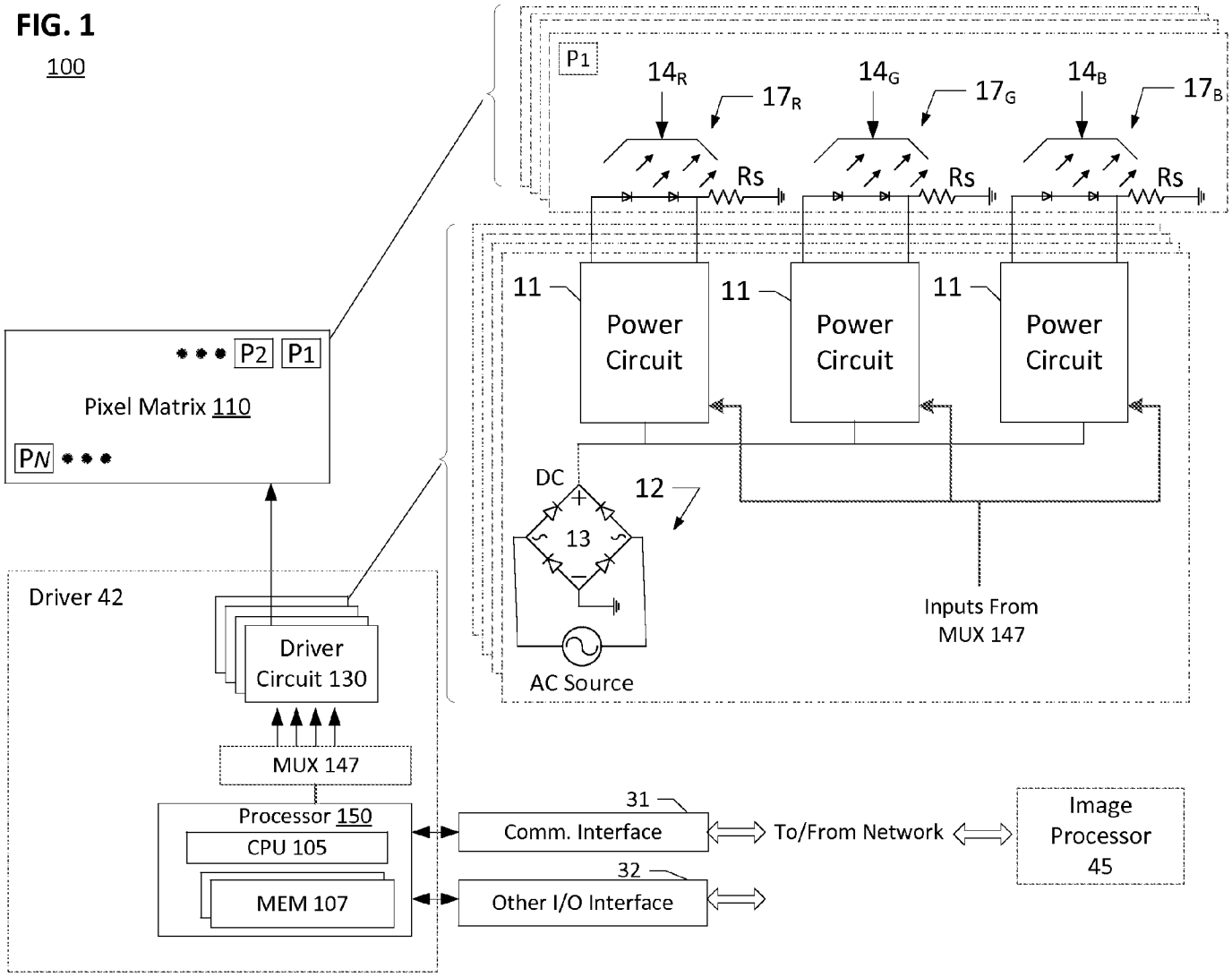
FIG. 1 shows an example of a lighting system, in high-level block diagram form.

Reference now is made in detail to the examples illustrated in the accompanying drawings and discussed below. FIG. 1 is a high level block diagram that illustrates an example of a lighting system 100. The system 100 may be implemented in an integral unit, such as a light fixture or other lighting device or as two or more interconnected components.

In this example, the lighting system 100 includes a pixel matrix 110 of light emitters. Each light emitter at a respective pixel, shown as $P_1$, $P_2$, . . . $P_N$ of the pixel matrix 110 includes a source of light configured to be controlled to vary a characteristic, such as intensity and color, of light emitted from the respective pixel. The light emitting pixel matrix 110 could be an actual display device, for example, with an m by n pixel matrix of light emitters, such as RGB emitters (where m and n are integers), similar to back lit liquid crystal display (LCD) panels of flat screen monitors and televisions. In other examples, the pixel matrix 110 might be formed of an n by m pixel matrix of RGB light-emitting diode (LED) sets or red, green, blue, and white (RGBW) LED sets. In either of these examples, there may be additional color emission channels based on other color models. For example, color emission channels may be provided for other color models such as cyan, magenta, yellow, and black (CMYK), or hue, saturation and value (HSV) or custom color emission channels may be created that have any number of color emission channels appropriate for provided desired color emissions from a lighting system 100. Also, it should be understood that other color emission combinations may be used in place of the RGB or RGBW sources. LCDs and LEDs are given by way of example only, and other pixel matrix emitters may be used, such as a plasma display, an organic LED (OLED) display, or the like. In addition, the pixel matrix emitters envisioned for a lighting system like 100 provide lighting suitable for use as task lighting when used as a lighting device in a space intended for human occupation.

The lighting system 100 also includes an appropriate image responsive driver circuit 130 connected to the pixel matrix 110. The driver circuit 130 is configured to control the light emitters at the pixels of the matrix 110 in response to an image input. The driver circuit 130 may be similar or the same as a video driver of a resolution corresponding to the number of pixels $P_1$, $P_2$, . . . $P_N$ and/or pixel dimensions (i.e., x by y) of the matrix 110. In this example, the each of the pixels of the matrix 110 includes three separately controllable light sources, specifically a red (R) source $\mathbf{14}_R$, a green (G) source $\mathbf{14}_G$ and a blue (B) source $\mathbf{14}_B$. Adjustment of the outputs of the sources $\mathbf{14}_R$, $\mathbf{14}_G$, $\mathbf{14}_B$ can provide tunable illumination. While RGB color lighting is described, the pixels $P_1$, $P_2$, . . . $P_N$ may be capable of generating light, such as hyperspectral light that is composed of a number of different wavelengths of light that permits tuning of the pixel matrix 110 output to provide task lighting, if needed. Of course, other colored light systems such as RGBW, cyan, magenta, yellow and black (CMYK) or hue saturation value (HSV) may be used.

The lighting system 100 includes the pixel matrix 110 and may include some of the other illustrated system elements. In the example shown, the matrix 110 of the lighting system 100 utilizes solid-state lighting (SSL) type of light sources. Although other types of switchable light sources may be used, particularly other types of solid state light emitter(s), in the illustrated example of system 100 each of the SSL light emitting sources includes some number of (one or more) light emitting diodes (LEDs) 17 (individually referred to as $\mathbf{17}_R$, $\mathbf{17}_G$, and $\mathbf{17}_B$) that together form the respective SSL type light source 14 (individually referred to as $\mathbf{14}_R$, $\mathbf{14}_G$, and $\mathbf{14}_B$). Hence, each source $\mathbf{14}_R$, $\mathbf{14}_G$, $\mathbf{14}_B$ includes a group of LEDs of a corresponding color, in this example, red (R) LEDs $\mathbf{17}_R$, green (G) LEDs $\mathbf{17}_G$, and blue (B) LEDs $\mathbf{17}_B$ as well as a source resistance $R_S$. Each group of colored LEDs $17_R$, $17_G$, or $17_B$ may be connected in parallel, in series or in any viable series-parallel combination; although in the illustrated example, each respective group of colored LEDs $17_R$, $17_G$, or $17_B$ is connected together in a single series string.

The lighting system 100 in FIG. 1 includes a controllable/variable output power circuit 11 as the drive and control channel for each light output channel provided by, for example, the different color sources $14_R$, $14_G$, $14_B$. For ease of discussion, the following examples refer to three (e.g., RGB) color channels, but it should be understood that other color models and/or a different number of color channels may be implemented with corresponding revisions to provide the implemented number of color channels.

The power source could be a direct current (DC) source, such as a battery; but in the example, the system 100 obtains power from alternating current (AC) source at normal line voltage (e.g. around 120V in the US). Although not shown, one or more protective fuses may be provided in the line connection(s); and some additional smoothing and/or control circuitry may be provided on the power input side, between the bridge rectifier 13 and the power circuits 11.

In another example, instead of a single bridge rectifier 13 for supplying direct current to each power circuit, a power converter (not separately shown) in each power circuit 11 is configured to convert power from the AC source of power to direct current to supply the respective solid state light emitting source.

Each power circuit 11 may be connected a control circuit, such as processor 150 via a multiplexor 147, to control operation and to set the overall output level of the drive current and thus the light output of the respective colored LEDs $17_R$, $17_G$, or $17_B$ forming the solid state light emitting source $14_R$, $14_G$, or $14_B$ of the respective pixel. In the example, each power circuit 11 receives, via the multiplexor 147, a separate independently controllable input signal from the processor 150.

The lighting system 100 may implement a variety of overall host control/operation technologies that provide the high level logic to control operation of the pixel matrix 110 including data transmission; although the illustrated example uses the processor 150. The processor 150 implements the control logic for the system 100, that is to say, controls operations of the lighting system 100 based on execution of its embedded 'firmware' instructions. The processor 150 may be a microchip device that incorporates a programmable central processing unit (CPU) 105 of the processor 150 and thus of the lighting system 100 as well as one or more memories 107 accessible to the CPU 105. The memory or memories 107 store the executable programming for the CPU 105 as well as data for processing by or resulting from processing of the CPU 105. The processor 150 has a number of outputs to independently provide the control and data signals to the respective power circuits 11 via the multiplexor 147. The number of outputs may be individual output ports or a single port with signals addressed to the respective, individual power circuits 11. Note that the illustrated configuration is only an example, and other configurations, such as incorporation of the power circuits into the pixel matrix are envisioned. Also, one processor 150 may control a single pixel matrix light generation unit 110 or may control operation of any number of similar pixel matrix light generation units.

In the example, the lighting system 100 includes a communication interface 31 coupled to a communication port of the processor 150. The interface 31 provides a communication link to a telecommunications network that enables the processor 150 to receive and possibly send digital data communications through a particular network. The communication interface 31 is therefore accessible by the processor/CPU 105 of the processor 150, and the communication interface 31 is configured to enable the processor to communicate information about its operations as well as data sent or received as communication on any of the three light channels in our example through a LAN or other communications network (described in more detail with respect to FIG. 5). For example, the communication interface 31 allows the lighting system 100 to receive files suitable for providing the manipulated lighted effects described herein. The received files may be files containing, for example, source images for manipulation by the processor 150 according to the examples described herein. In this case, the processor 150 may execute a process as described with reference to FIG. 3A-3C or 4A-4C that manipulates data of a source image. After manipulating the source image, the processor 150 of lighting system 100 may generate an image file that is shared with other devices within the lighting system 100. The sharing of the generated image files will be described in more detail with reference to FIG. 5.

Alternatively, the received files may contain manipulated image files for direct presentation via the pixel matrix 110. In some examples, the received image files contain frequency domain data that may be pre-processed (e.g., applying some form of thresholding or filtering to frequency domain data) before being further processed by applying inverse transformations to generate output image data. In addition, the processor 150 is configured with input/output interface 32 for receiving inputs, such as control signals, status information, data signals such as an image file, or the like from devices connected within the lighting system, such as another lighting device, a connected computer or the like, and for providing outputs, such as status information, control signals or the like.

The image input to the driver circuit 130 may be an analog or digital signal. The image input may be a still image of a real scene, such as a real object, landscape or the like; a non-real-time sequence of images, a computer generated image that is representative of a real object or real scene, an image of a fabricated scene or the like; or a video signal (typically corresponding to a real-time sequence of images). In the system 100, however, the image input signal to the driver circuit 130 represents an image corresponding to data produced by manipulation in the frequency domain. The principles of the systems and methods discussed below may be adapted to three dimensional images. For discussion and illustration purposes, the examples process two dimensional image signals and generate visual outputs of two dimensional images. The image input therefore provides a signal to cause the driver circuit 130 to operate the pixel matrix 110 to output light in a manner that may be seen by an observer as a two dimensional image on the output screen of the pixel matrix 110.

A source image signal or file often will be a representation of a scene or object captured by a camera or other image input device. The source image signal or file may be, for example, one or more video frames in a sequence of video frames obtained from a video stream representation of the scene or object. In another example, the source image may be a single image frame, such as a still image. The image file input to the driver circuit 130 represents an image, and the image input causes the driver circuit 130 to operate pixel matrix 110 so that the visible image produced by the emitted light does not necessarily show any particular scene or object due to frequency domain manipulation of the input image.

The images or image signals/inputs to the driver circuit 130, in this case, therefore are representations of graphical information in image space. The light emitted in response to such image signals/inputs will differ in intensity and color at the pixels of the matrix. Differences in color will be described herein in terms of wavelengths, for convenience.

This type of system example also includes an image data processor. The image data processor may be a separate device, such as a remote computer; or in the example, the processor 150 that controls the lighting operations may also be the image data processor. Examples are described in more detail later where the image data processor is the processor circuitry forming the central processor (CPU) of a host/server computer or end user computer terminal, which in turn supplies an image file containing an image domain data set for use by actual lighting devices. The image data processor may also include a memory for storing the image file as well as any data, such as frequency domain data sets generated during intermediate steps of the disclosed image processing particularly in the frequency domain.

At a high level, the image data processor obtains a frequency domain data set corresponding to an image and manipulates at least one aspect of the frequency domain data set to form a manipulated frequency domain data set. The image data processor transforms the manipulated frequency domain data set into an image domain data set and supplies the image input for use by the driver circuit, based at least in part on the image domain data set. The manipulated at least one aspect may be, for example, any parameter value of the frequency domain data set. For example, in a frequency domain data set generated by application of a Fourier transform to a source image, a manipulated aspect of the frequency domain data set may be one or more of a direction, a phase, frequency or a magnitude value.

In an example, the performance of the described frequency domain transformation and frequency domain manipulation by the image data processor may be performed by the lighting system processor 150, which supplies the image input domain data set as an image input to the respective driver circuits 130. In another example, the described frequency domain transformation and frequency domain manipulation may be performed by an image data processor separate from the lighting system 100, such as image processor 45. In this case, the image processor 45 supplies the image input domain data set as an image input to a driver 42 via a network connection to the communication interface 31. The driver 42 is configured to provide signals to the respective driver circuits 130 for generating an output image. An example of a system incorporating image processor 45 will be described in more detail with reference to FIG. 5.

Figure 2:
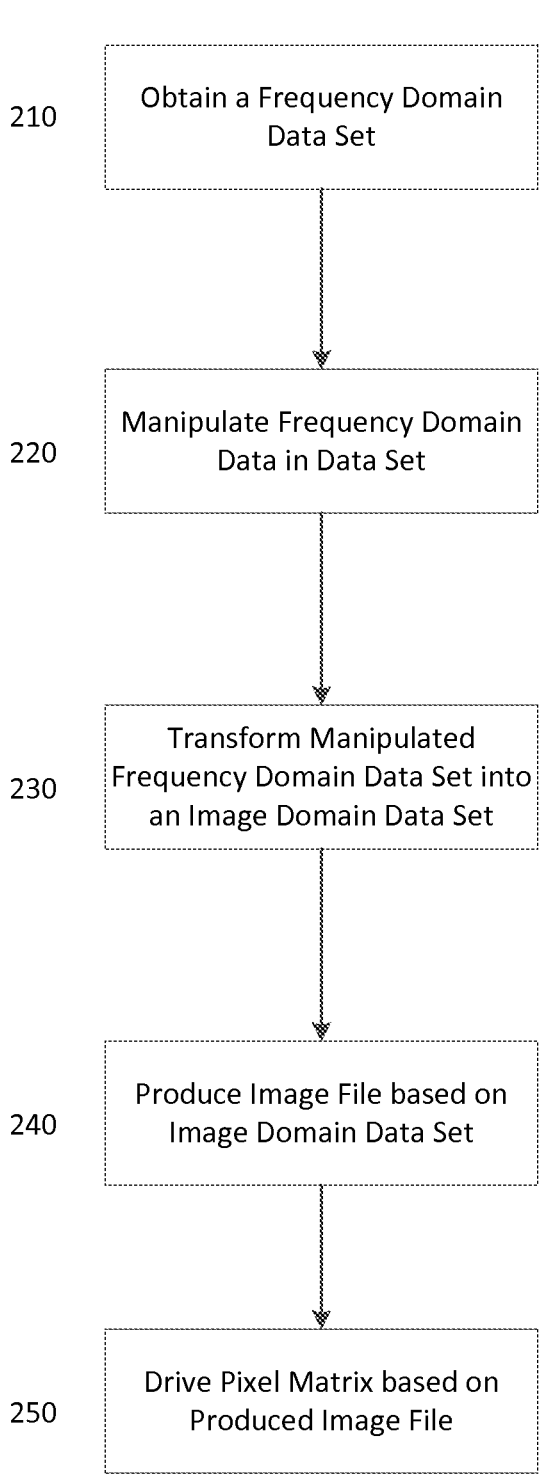
FIG. 2 is a high-leveled flow chart of method involving manipulation in the frequency domain to produce an image for use by a multi-pixel color lighting device.

FIG. 2 illustrates a high-level process 200 for providing an output image for a lighting system. At a high level, an image data processor obtains (210) a frequency domain data set corresponding to an image. At least one aspect of the frequency domain data set is manipulated (220) to form a manipulated frequency domain data set. An image processor transforms the manipulated frequency domain data set into an image domain data set (230). An image file is produced based on the image domain data set (240). At 250, a pixel matrix is driven based on the produced image file.

A frequency domain transform or frequency domain data set for a real mathematical function, or in this case for a real image, represents the real function as values related to the characteristics of frequency components that make up the real function. Where the real function is a two-dimensional image, as in our examples, the data set in the frequency domain relates to characteristics such as magnitude and phase of the wave components that make up the image. In an image, frequency is not necessarily related directly to time. Each frequency of wave component of an image may be thought of as the number of cycles per unit length or distance across the image.

In the described examples, the frequency domain data set is obtained from a transform of a source data image, specifically to a transformation of the source image data from the spatial image domain into a frequency domain representation of the image. At a later stage after data manipulation, a corresponding inverse transform transforms the processed frequency domain data back into spatial image data. The examples use Fourier and inverse-Fourier transforms, although other transforms such as Laplace, Gabor or Z-transforms and the inverses thereof could be used. A Fourier transform of, or corresponding to, an image, for example, produces a frequency domain data set that includes an array of magnitude terms for frequency components from the Fourier transform of the image, and an array of phase terms for frequency components from the Fourier transform of the source image. In an example, it is envisioned that a data set may be built by a computer directly in the frequency domain space for manipulation and inverse transformation, rather than using a source image and Fourier transform to produce the initial frequency domain data set.

Figure 3A:
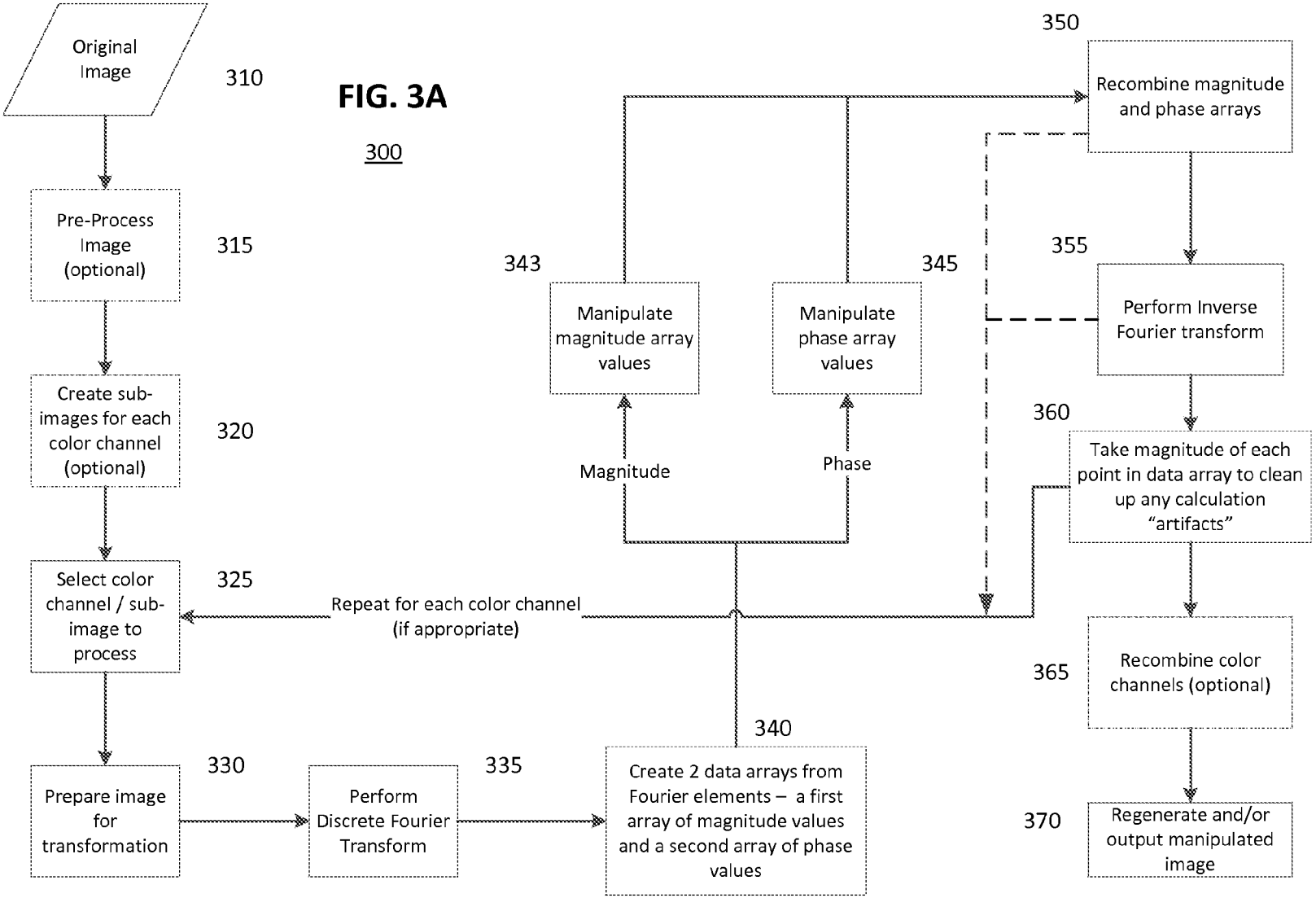
FIG. 3A is high-leveled flow chart of a detailed method involving manipulation in the frequency domain to produce an image for use by a multi-pixel lighting device.

FIG. 3A is a flow chart of relevant processing related to a phase masking example that provides the desired lighting effects.

The phase masking process 300 begins when an initial image is received by an image data processor configured or connected supply an image file or the like to the lighting system (310). The initial image may be a color image that is a digital representation of a real image scene, such as a picture of a landscape (e.g., mountains, lake, desert, foliage, flower(s), sky, etc.), an object(s), persons, patterns (e.g., plaid, herringbone, or the like) and the like; a painting, a drawing, a computer generated image, or the like. A benefit of computer generated images is that the image does not need to be collected by a camera, and a provider of computer generated images is able to develop their own scenery. Another benefit is that by manipulating the image characteristics in the frequency domain, a user is able to more precisely limit the amount of details in a presented image regardless of the amount of detail in the source image. The lack of detail in the presented images keeps the distractions to the viewer at a minimum. Hence, in some examples, the amount of distraction potentially caused by the image is minimized, but a psychologically soothing effect to the viewer is still provided. In other examples, the desired psychological effect to be elicited from a viewer may be one of comfort so the viewer lingers a bit longer (as in a retail setting). Conversely, the desired psychological effect may be discomfort so the view does not loiter in an area, such as an access point to a public venue (e.g., a stadium) or the like. Of course, presented images that elicit other desired psychological effects on viewers, such as alertness, disorientation, joy or the like may also be provided.

After obtaining the source image at 310, the image data processor may optionally process the initial image in order to make the image easier to manipulate (315). For example, the preliminary image processing, or pre-processing, may crop the image, adjust contrast, perform edge enhancement, shading correction, noise suppression, adjust color saturation settings, and the like. In an example, the pre-processing may include converting the color space of the image, which may be of a first color space, into another, or second, color space used by a luminaire(s), or lighting device. For example, the initial image may have three color channels, such as RGB, and the color space of the luminaire has a different number or set of channels, such as RGBW. In this case, the initial image may be converted (i.e., pre-processed) to the luminaire's color space prior to the Fourier transform process. It is also envisioned that this processing may also be a conversion after the Fourier transform but prior to application of an inverse Fourier transform that transform the frequency domain data set to image space at the end of the process.

Where the source image is a color image, another optional operation may be to create, at 320, sub images for each color channel. The output of this and following operations are illustrated in more detail with reference to both FIGS. 3A and 3B. In other words, the source image may be processed to locate the image data in each of a particular color channels that form the initial image; and, as a result, the source image is separated into a number of different color characteristic images, each different color characteristic image corresponding to a respective one of a plurality of color control channels of light emitters of a pixel matrix in a lighting system. For example, the image may be filtered into the RGB color channels, which are shown across the top of FIG. 3B. The RGB channels may be relatively narrowband and therefore monochromatic or may have broader bandwidths albeit centered around principal wavelengths in the respective, R, G, B regions of the visible spectrum. The channels may also include a further or broader bandwidth channel that may often be considered as visible white (W) to a human observer. Of course, other color channelized systems, such as, CMYK, HSV, white only, monochrome (single color) systems, black and white, and/or grayscale, may also be used. However, for ease of discussion, the RGB color channels will be referenced through the rest of the specification, and the described techniques may be applied to the other color channelized color system.

The image data processor, at 325, selects a sub-image of color channel, such as the red R channel sub-image, for further processing. The further processing may include creating a data array, for example, a n×m array of pixel intensities in the respective color channel in real space, from the selected sub-image data, and formatting the data array in preparation (330) for applying a transformation to the data array. Preparation of the data array for application of the transform may be, for example, arranging the data as comma separated values in vector array incorporating all of the n×m array values (e.g., from top left of the source image to bottom right of the source image); rounding of values to conform to a decimal value limitation of the image data processor, or some other formatting. In an example, the preparation may include resizing the data array to optimal dimensions for the transformation procedure. For example, if using a radix-2 Fast Fourier Transform (FFT), the image might be resized and/or cropped so n and m are both powers of 2. The most common version of this FFT is the Cooley-Tukey algorithm. Of course, there are different data array dimensions that are optimal, not only for the application of Fourier transforms, but for the application of other types of transformations, such as Gabor, Laplacian, Z, that may be utilized to process the image data.

The transformation (335) from real space of the frequency domain may be a discrete Fourier transform, a Laplacian transform, Z-transformation, Gabor transform, or the like. For ease of discussion, a Fourier transform will be described with reference to examples illustrated in the figures. At 335, a discrete Fourier transform is applied to the data array of the source image, which results in a frequency domain data set corresponding to the source image data. The following is an example of a suitable Fourier transform that may be applied to the created data array of the source image:

where:

$$F(s,t)=\sum_{r=1}^{n}\sum_{c=1}^{m} f(r,c)e^{-i2\pi\left(\frac{(r-1)(s-1)}{n}+\frac{(c-1)(t-1)}{m}\right)+i\pi(r+c)}$$

i is the Imaginary constant, $i\equiv\sqrt{-1}$;

e is Napier's constant, $$e\equiv\lim_{n\to\infty}\left(1+\frac{1}{n}\right)^{n}\approx 2.718\ \ldots\ ;$$

π is Pi, π≈3.1415 . . . ;

f (r,c) is an n×m array of pixel intensities in real space with row and column indices r and c respectively; and F (s,t) is an n×m array in Fourier space with row and column indices s and t respectively.

Notes:

Double summation means that for any given location in a particular color channel in "Fourier space" (i.e., the frequency domain data set), there is some contribution from every color channel pixel in the "Image space";

First term in exponent, $$-i2\pi\left(\frac{(r-1)(s-1)}{n}+\frac{(c-1)(t-1)}{m}\right),$$

applies a phase to each pixel in "image space" before adding all the pixels together;

Second term in exponent, iπ(r+c), is used to make calculated Fourier transform match what would be seen using an optical (e.g., using optical lenses) Fourier transform (i.e., a Fourier transform within the two dimensional spatial domain); and In some examples, the scaling/normalization of the data is performed when the inverse Fourier transform is applied. However, the scaling/normalization of the data may could be done either partially or fully in the Fourier transform.

Each of the data elements in the respective points of the source image function f(r,c) includes a real number value at each of the respective pixel locations that represents the intensity for that for that pixel. In addition, a pixel as used herein refers to a point in the respective color channel of the source image. Each of the data elements in the respective points of the Fourier space image function F(s,t) includes a magnitude and a phase. The magnitude of the complex value describes the amplitude of the wave and the phase of the complex value is describes the phase of the wave.

When applied to a source image, a Fourier transform provides an array (e.g., n by m, where n and m are integers) of complex values describing a set of waves that, in the aggregate, describe the source image. Each wave has four parameters: direction, frequency, magnitude (i.e., amplitude), and phase. Each of the complex values in a frequency domain data set has a real component and an imaginary component that together describes one wave, in terms of direction, frequency, magnitude and phase, in the set of waves that describe the source image. Direction and frequency (from which wavelength may be derived) are given by the relative position of a respective Fourier transform array point to a central point of the array (i.e., zero-th ($0^{th}$) order term) and are therefore inherently encoded into the array by the fact that each component has a given position within the array. After application of the Fourier transform, a frequency domain data set corresponding to the source image is obtained. The frequency domain data set (i.e., complex valued array) generated by the application of the Fourier Transform includes two "sub-arrays": a magnitude array representative of respective wave amplitudes and a phase array representative of respective wave phases.

At 343 of the example of FIG. 3A, the magnitude array values are not manipulated, but may be manipulated in subsequent processing or in other examples. At 345, the phase array values are manipulated, or modified, to reduce a level of detail in the image. For example, the phase array values are manipulated to zero out phase values for all data value elements in the array that represent an order higher than a preselected order. For example, data value elements in the array that represent phase of a frequency component of frequency order higher than 20 are set to zero to mask out phase data for high order components. (See FIG. 3B, for example). The "order" of a component refers to the relative frequency of that component within the frequency domain data set. In the present example, when presented as an n×m array, the lower frequency and "lowest order" values are located closer to the center of the array, while the higher frequency and "higher order" values are located radially outward from the center of the array. For example, in the example shown in step B of FIG. 3B, the "highest order" values are located farthest from the center of the magnitude array (beneath the label "Magnitude before"), and the lower order values (i.e., zero-th order) are located in the center of the magnitude array. The phase array (beneath the label "Phase before") has a similar configuration of lower-to-higher frequency orders except are related to phase angles of particular frequencies instead the magnitude value associated with the respective frequency component. In other examples, the zeroth order element(s) may be implemented in a given corner or given corners, and the highest order components may be implemented near the center of the array.

Hence, the phase array values are manipulated, for example, by masking out terms from the array of phase terms for Fourier transform frequency components of the source image exhibiting a predetermined characteristic. In other words, the image data processor manipulates at least one aspect of the phase array values of the frequency domain data set to alter the effects of the higher frequency image data, which, for example, corresponds to the edge details in the respective color channel of the source image. As a result, the resulting output images may have reduced sharpness at the edges as compared to the source image and may appear as a blurred version of the source image. Recall from the discussion above that a Fourier transform provides an array of complex values describing a set of waves that, in the aggregate, describe the source image. Based on the manipulation of at least one aspect of the phase array values in the frequency domain data set, the respective parameters of the set of waves that, in the aggregate, describe the source image are changed. As a result, the locations of a portion of the waves in the set of waves after the application of the Fourier transform are different after the manipulation and the application of the inverse Fourier transform. Other modifications may include random reductions of different frequency component data value elements in the phase array and/or the magnitude array to provide different image effects. For example, another modification may be to randomize the existing higher order data or to generate completely new random numbers for the higher order data, such as by using a statistical construction method that may be applied to the magnitude array, the phase array or both.

Upon completion of the manipulation of the phase array values, the magnitude array values and the manipulated phase array values are recombined to form a manipulated Fourier frequency domain data set (350). At this point, the process steps of 325-350 may repeat for another color channel, or may proceed to step 355.

At 355, an inverse Fourier transformation is applied to the manipulated Fourier frequency domain data set for respective color channel to form a new image domain data set for the respective color control channel of the light emitters of the pixel matrix.

For an example after applying the Fourier transform function discussed earlier, the following is an example of a suitable inverse Fourier transform that may be applied to transform a Fourier domain data set into a modified image domain data set:

where:

$$f(r, c) = \frac{1}{n \times m} \sum_{s=1}^{n} \sum_{t=1}^{m} F(s, t) e^{i2\pi\left(\frac{(r-1)(s-1)}{n} + \frac{(c-1)(t-1)}{m}\right)}$$

i is the Imaginary constant, $i \equiv \sqrt{-1}$;

e is Napier's constant, $$e \equiv \lim_{n \to \infty} \left(1 + \frac{1}{n}\right)^n \approx 2.718 \ldots ;$$

π is Pi, π≈3.1415 . . . ;

f (r,c) is an n×m array of pixel intensities in real space with row and column indices r and c respectively; and F (s,t)—is an n×m array in Fourier space with row and column indices s and t respectively.

Notes:

Double summation means that for any given pixel" in "Image space", there is some contribution from every "pixel" in "Fourier space";

Term in the exponent, $$i2\pi\left(\frac{(r-1)(s-1)}{n} + \frac{(c-1)(t-1)}{m}\right),$$

applies a phase to each "pixel" in "Fourier space" before adding all the "pixels" together;

All scaling/normalization (i.e., the 1/(n×m) value is a normalization value) is done in the Inverse Fourier process in this example, but could be done either partially or fully in the Fourier process in other examples; and As part of the "array cleanup", the magnitude of each output pixel can be taken to remove any imaginary components left over from accumulated numerical (e.g., round off) errors—this also effectively reverses the effect of the $i\pi(r+c)$ term in the original Fourier transform.

At this point, the resulting new image domain data set for the particular color channel may include numerical error (e.g. rounding errors) and calculation "artifacts," such as small, non-zero imaginary components or negative values in the new image domain data set. All values in the image data domain are expected to be positive and real-valued.

In order to more easily (mathematically and computationally) process the image domain data set, the processor, at 360, applies a set of rules (e.g., thresholds, limits and the like) to eliminate any calculation artifacts. In particular, the magnitude of each pixel in the image domain data set of each channel image is processed to remove any complex number component (or phase-related) value information from the respective pixel value that, for example, accumulated from numerical errors. In practice, keeping only the magnitude of the new image domain data set also reverses the effect of the $i\pi(r+c)$ term in the applied Fourier transform.

The steps 330-360 may be repeated for processing of image data additional color channels. For example, if three channels RGB are used, a first pass through steps 330-360 might process data for the red (R) channel, then if there is processed image data available from another color channel, such as green or blue, available for processing, the process steps 330-360 may be repeated for green (G) and then repeated again for blue (B). In other words, another frequency domain data set corresponding to another color channel of the source image is obtained, at least one aspect of the other frequency domain data set is manipulated via steps 330-345 to form another manipulated frequency domain data set for the respective color channel that is combined with the manipulated frequency domain data sets of the other color channels and transformed to produce a corresponding new image domain data set.

At 365, the processor may recombine the resulting manipulated image domain data sets for the color channels (e.g., R, G and B) into an image domain data set from which an RGB image may be generated via an image/video driver and a pixel matrix light output device. However, the recombining of the respective color channel manipulated image domain data sets may be unnecessary for reproduction, e.g. if the driver and output device can be driven by the individual color channel image domain data sets, in which case, step 365 may be optional.

The image domain data set (or individual color channel image domain data, if not recombined at 365) may be regenerated and/or modified as an image input to a driver, or the data set may be converted to another suitable format, e.g. into an image file in a standardized format, such as JPEG or MPEG (370). The produced image file is used to control operation of a multi-pixel lighting system, based at least in part on the manipulated image domain data set.

In addition, post-processing, such as color conversion, may also be performed after any of steps 360-370 or at the individual pixel level (i.e., pixel instructed to display a given color point, in which case each pixel control circuit is configured to perform the post-processing.)

The manipulated image generated from the image domain data set for presentation by an image display device includes a level of image detail aimed at minimizing distractions to a viewer. For example, the manipulated image may contain subject matter the details of which are randomized, or scrambled, due to the manipulation of the frequency domain data set. As a result, the manipulated image appears as an abstraction of the source image data. For example, the source image may be a representation of a forest-like covered canopy, but due to the manipulation of the frequency domain data set, the manipulated image appears similar to military camouflage. The abstraction of the manipulated image invites the viewer to make the mental leap from the presented image to the forest canopy.

Figure 3B:
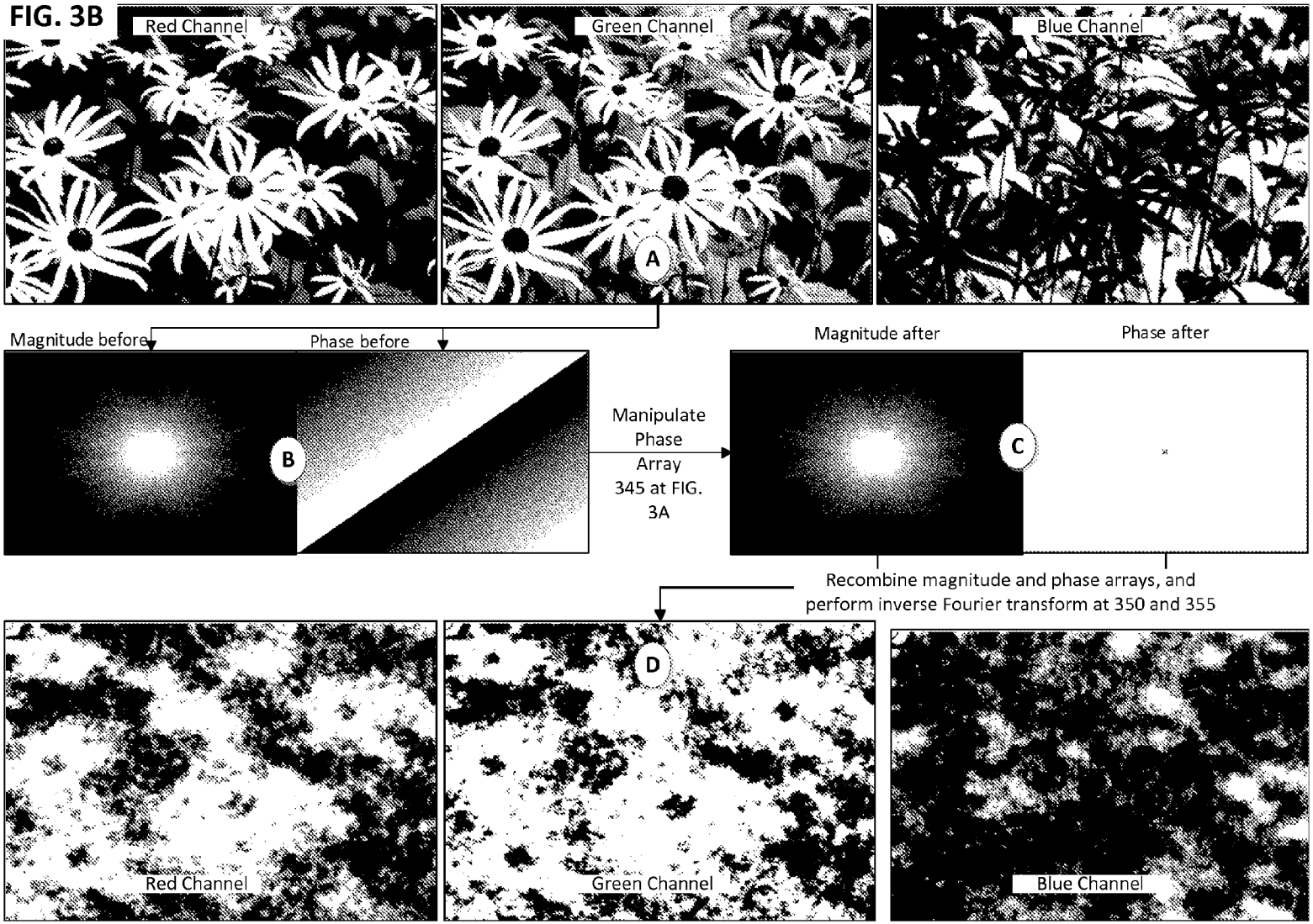
FIG. 3B illustrates examples of graphical depictions of data at selected operations of the flow chart of FIG. 3A.
Figure 3C:
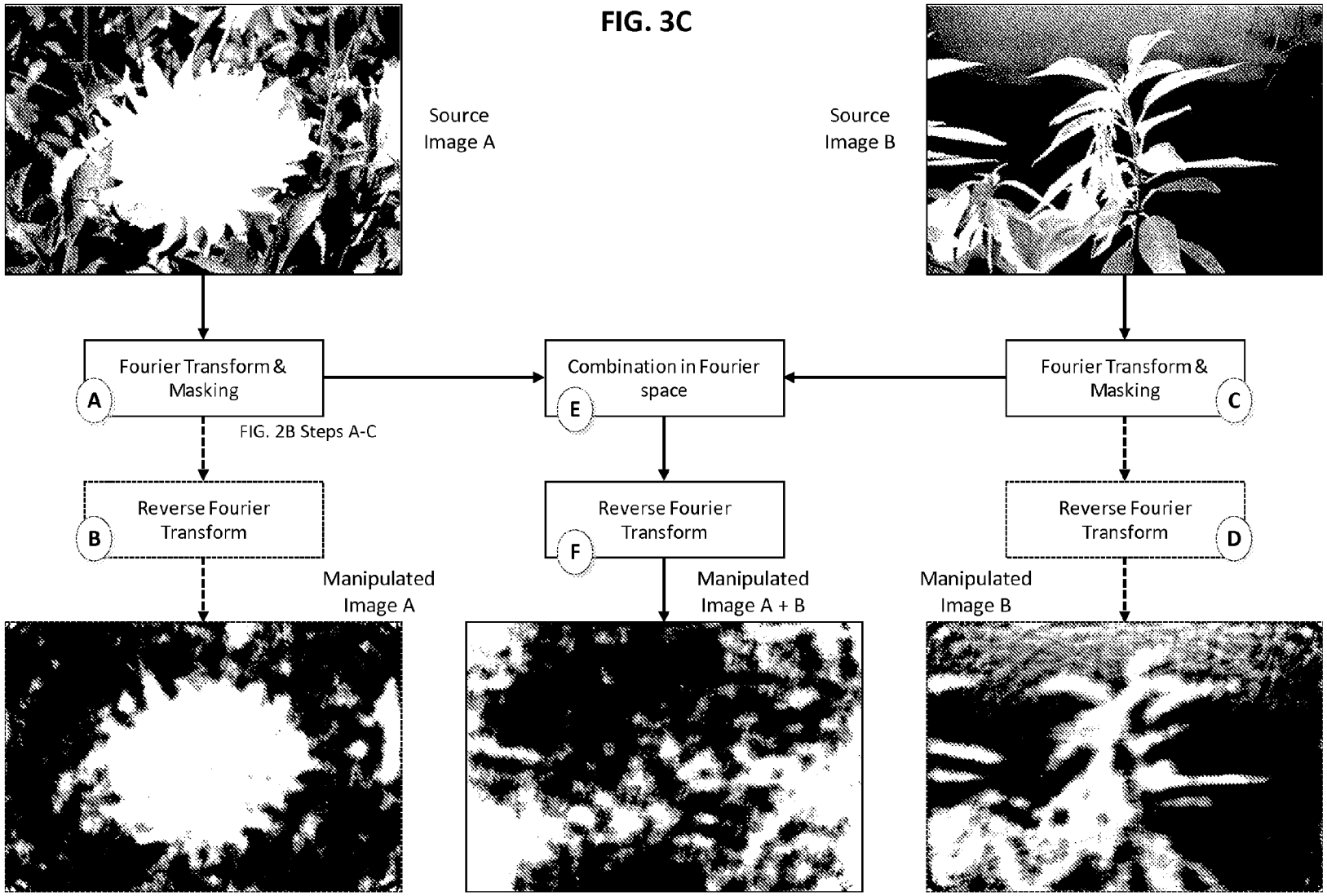
FIG. 3C illustrates a high-level block diagram of a process and graphical depictions of data during processing of two different images in a process like that of FIGS. 3A-3B as well as combination in the frequency domain to produce a third image.

FIG. 3B illustrates examples of graphical depictions of data at selected operations of the flow chart of FIG. 3A. Note that the graphical representations in FIGS. 3B and 3C depict graphical examples of the data generated at the steps of process 300 referenced in the respective figures, and are presented in the drawings as the data at respective points in the processing may appear if concurrently presented on a display device. The graphical representations are provided for purposes of understanding the manipulation of the source image at the referenced process steps, and do not represent an output that is visible to a user of the disclosed processes, or lighting systems.

In FIG. 3B, the color channel data from step 320 of FIG. 3A may be presented as separate color channel images. Although shown as grayscale in FIG. 3B, each of the red, green, blue color channel images show different levels of detail of the source image.

In the example, one of red, green or blue color channel data arrays selected (at 325 in FIG. 3A) and shown as A in FIG. 3B is transformed using a Fourier transform. The results of the Fourier transform result in a magnitude array and a phase array, which if presented on a display device may appear as shown in B of FIG. 3B. For example, at B, the magnitude array may appear as the graphic labeled "Magnitude before" and the phase array may appear as the graphic labeled "Phase before." In the example process 300 of FIG. 3B, the phase array at B is manipulated according to step 345 of FIG. 3A. The resulting output of step 345 is a change to some or all of the values in the phase array, which if presented on a display device may appear as shown in C of FIG. 3B. For example, at C, the magnitude array may appear as the graphic labeled "Magnitude after" and the phase array may appear as the graphic labeled "Phase after." After the recombination of the magnitude and phase arrays at 350 and application of the inverse Fourier transform at 355 of FIG. 3A, the respective red, green and blue color channels formed from the manipulated phase array data values may appear, if presented on a display device, as shown in D of FIG. 3B. A comparison of, for example, the green color channel in A to the green color channel in D shows the abstraction of the source image green color channel in the manipulated green color channel. A similar abstraction of detail is evident in the manipulated red and manipulated blue color channels as compared to the source image red and source image blue color channels, respectively. As a result of the process illustrated in the flow chart of FIG. 3A, the regenerated and/or outputted manipulated image is more abstract than the source image. In other words, the manipulated image still includes the details of the source image, but by manipulating the magnitude and/or the phase components of the frequency domain data set by scrambling, or randomizing, the manipulated image when presented appears as an abstraction of the source image. As a result, the subject matter of the manipulated image when presented is not as visually recognizable as being the same subject matter as presented in the source image.

FIG. 3C illustrates a high-level block diagram of a process and graphical depictions of data according to examples of the disclosed subject matter. In FIG. 3C, a source image, Source Image A, is provided to a processor. At step A, the Fourier transform and masking are applied to the source image A. Step A is the operation of steps 310-350 of FIG. 3A and elements A-C of FIG. 3B. At step B of FIG. 3C, the inverse Fourier transform is applied to reverse the Fourier transform of step A, and, as described with respect to elements 355-370 of FIG. 3A, a manipulated image, manipulated image A, is the image output by an image display device. Similarly, source image B is provided to the processor. At step C, the Fourier transform and masking are applied to the source image B. Step C is the operation of steps 310-350 of FIG. 3A and elements A-C of FIG. 3B. At step D of FIG. 3C, the inverse Fourier transform is applied to reverse the Fourier transform of step C, and, as described with respect to elements 355-370 of FIG. 3A, a manipulated image, manipulated image B, is the image output by an image display device or the like.

In another example, the frequency domain data generated from the respective source image data Fourier transformed and masked in steps A and C is combined, at step E of FIG. 3C, in Fourier space (i.e., frequency domain data) to form a combined frequency domain data set. The combined frequency domain data set is inverse Fourier transformed, at step F, which results in a manipulated image A and B. The manipulated image A and B data may be provided to a processor for output by an image display device or the like.

The processes illustrated in FIG. 3C may be modified to provide different graphical effects when output. For example, an output device may present for a certain time duration manipulated image A. After the passing of the certain time duration, the output device may begin transition to presenting a portion of manipulated image A content and a portion of manipulated image B content. The transition time may be of such a duration that it is not readily apparent that the output image is changing. After a time and additional transitions, the proportions of the content of each of the respective manipulated images A and B changes so that the outputted image begins to have a greater resemblance to manipulated image A+B. After additional time and more transitions, the outputted image is manipulated image B. While just two manipulated images, A and B, are discussed above, it is envisioned that manipulated image data from any number of manipulated images may be combined in various proportions and/or with timing that allows for output of an image.

Figure 4A:
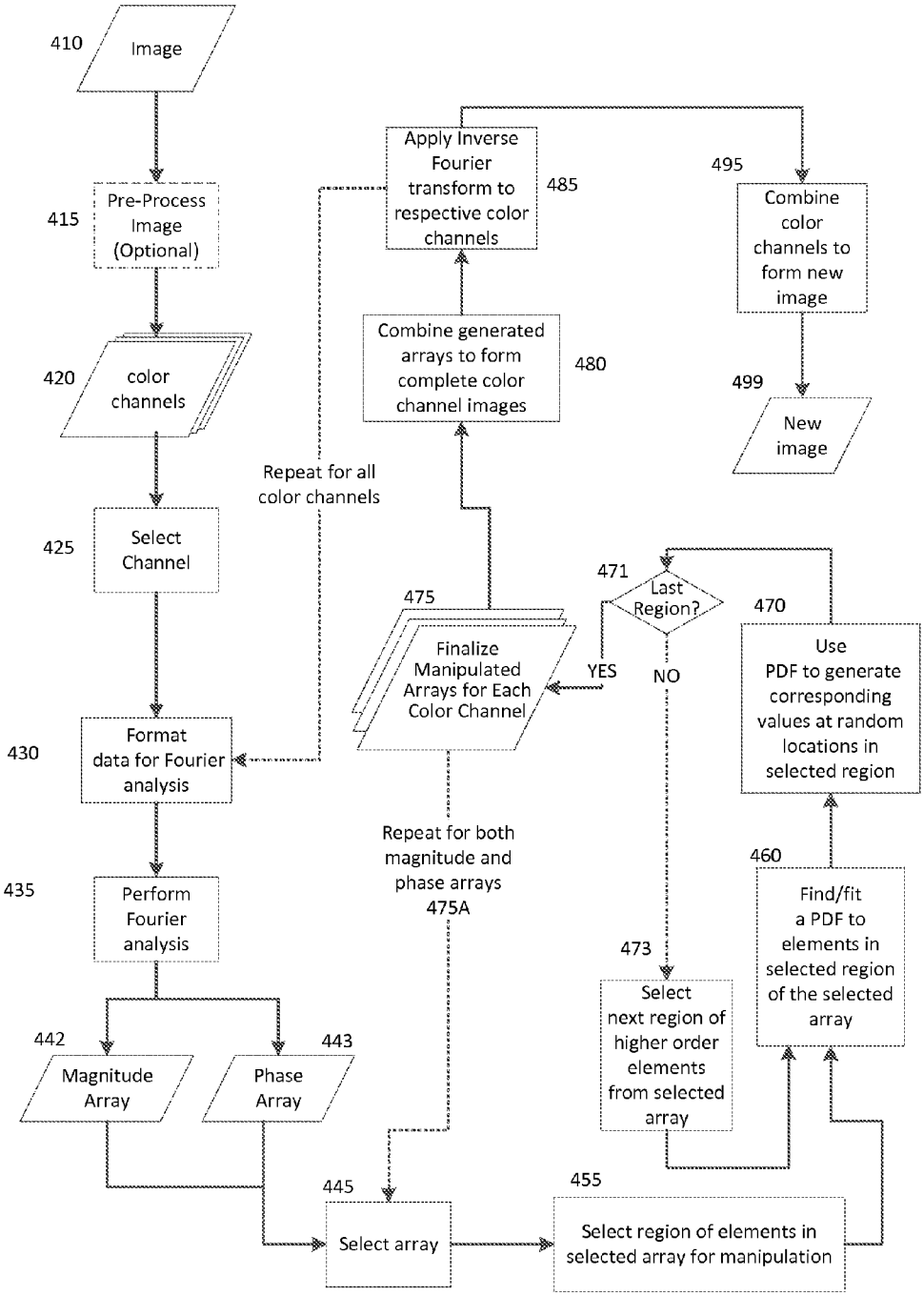
FIG. 4A is high-leveled flow chart of another detailed method involving manipulation in the frequency domain to produce an image for use by a multi-pixel lighting device.

In another example of generating a manipulated output image, FIG. 4A illustrates a flow chart of an example of frequency domain image processing related to a statistical image structure example that provides the desired lighting effects.

In the statistical image structuring process 400 of FIG. 4A, the process steps 410-425 are substantially the same as steps 410-435 performed in process 400. Therefore, a detailed discussion of steps 410-435 will be omitted.

Figure 4B:
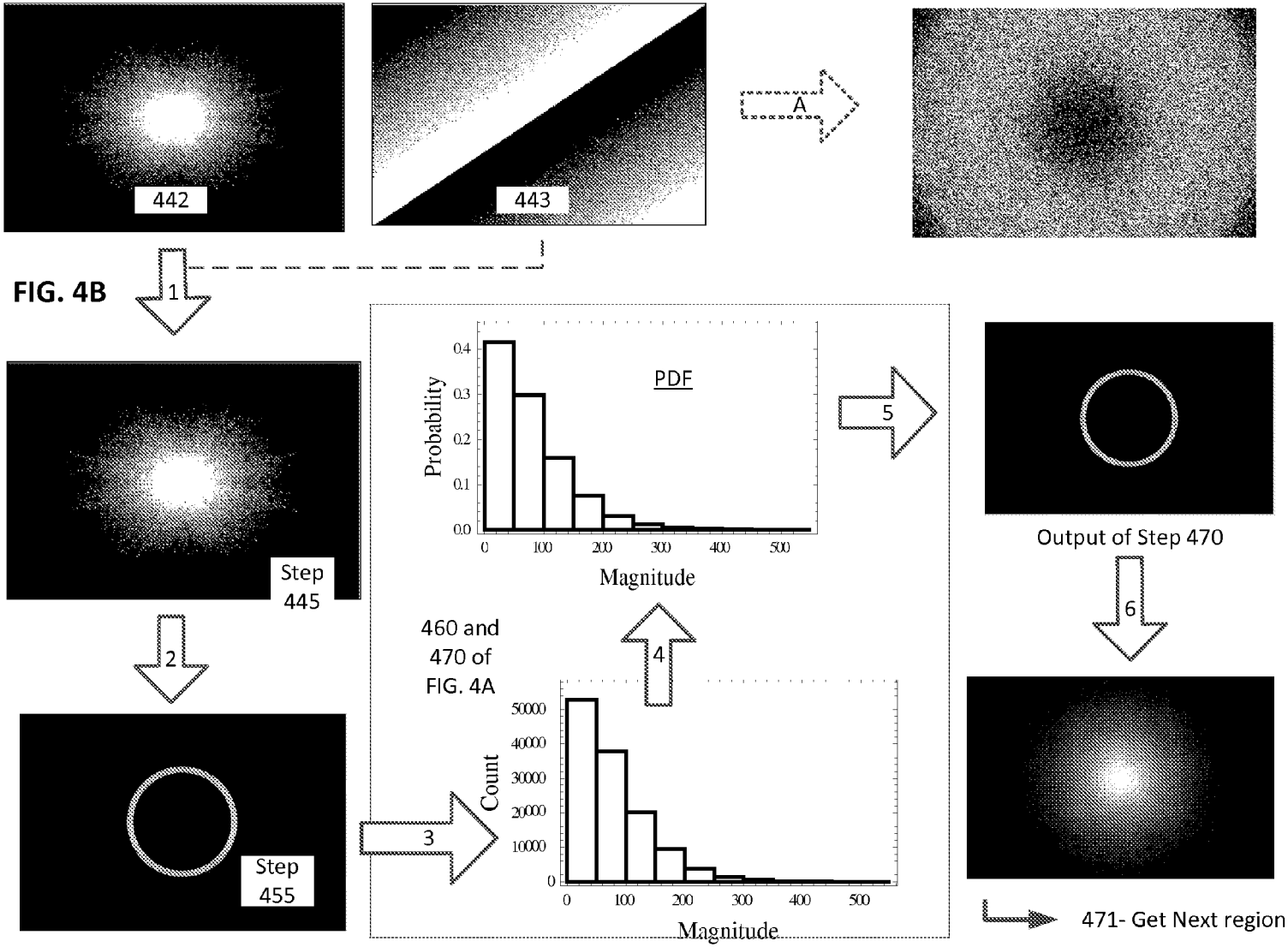
FIG. 4B illustrates high-level examples of graphical depictions of data at selected operations of the flow chart of FIG. 4A.
Figure 4C:
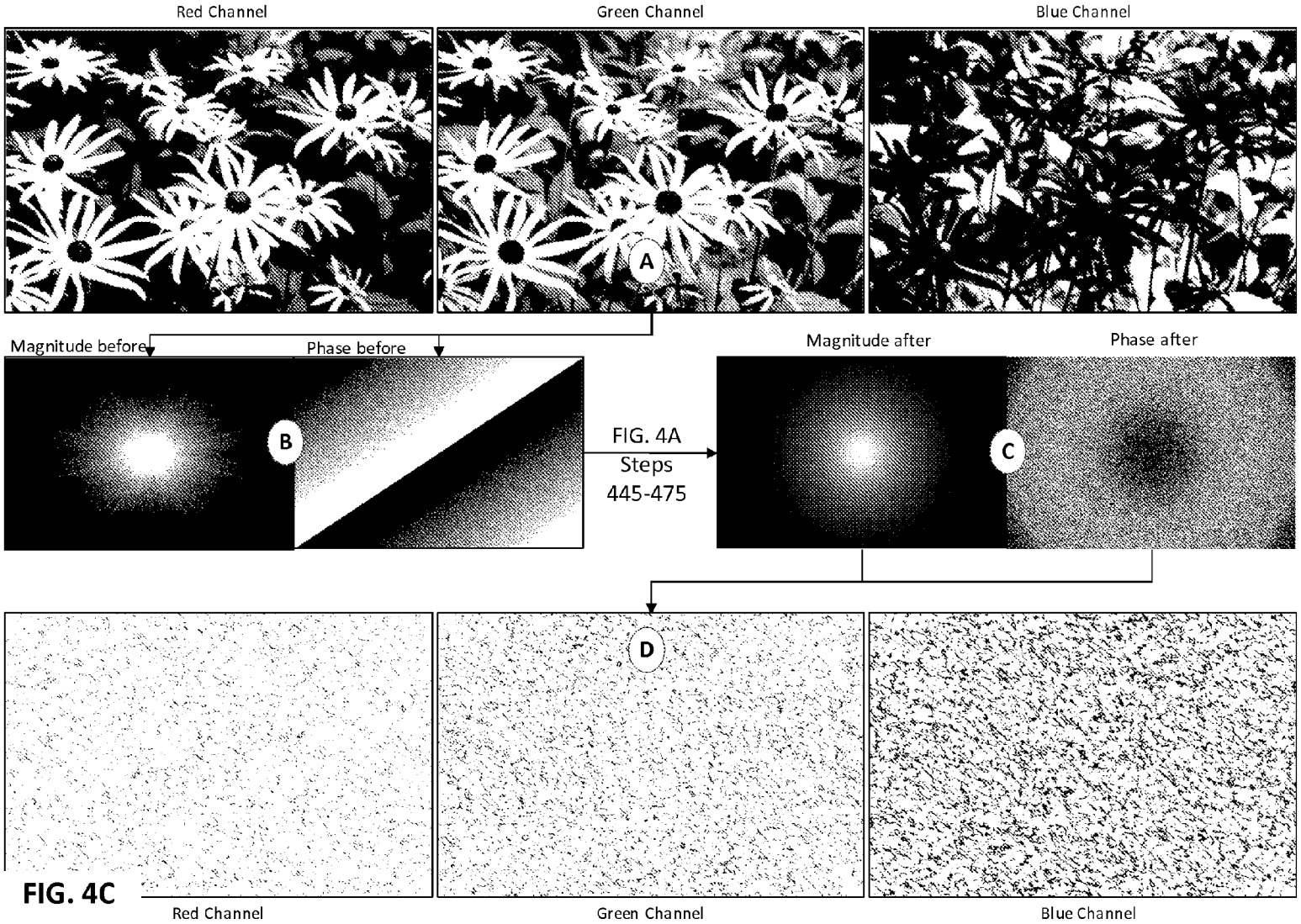
FIG. 4C is a high-level graphical representation of the process of FIG. 4A including examples of graphical depictions of data generated according to the disclosed subject matter.

The Fourier analysis of step 435 produces a frequency domain data set corresponding the selected color channel of source image received at 410 (See, for example, A of FIG. 4C). The frequency domain data set may be divided into a magnitude array 442 and a phase array 444 for the selected color channel (See, for example, B in FIG. 4C). At 445, the processor selects either the magnitude array 442 or the phase array 443 for manipulation. Upon selection of an array, the process proceeds to 455 at which a region of elements within the selected array are selected for manipulation. When an array is selected, the zero ($0^{th}$) order frequency value elements of the array are selected through a default process and are saved without being manipulated. The zero-th order frequency values of the magnitude array(s) 442 represent the average value of all elements within the original image. In other words, the zero-th order values of the magnitude array(s) represent the average luminance and/or average color temperature of the source image. Said differently, the zero order elements contain essentially no information about the details in an image, while higher order elements, first, second, third, etc. represent increasingly higher levels of detail present in the source image. In addition, by leaving the zero-th order values at the initial values in the magnitude arrays, the average color temperature of the source image, which includes all the color channels of the source image (e.g., all of the color channels separated in steps of 420 and 425 of FIG. 4A, is maintained). However, if it is desired to change the color temperature or average luminance of the source image, the zero-th order values may be manipulated. Note that the zero-th order values of the phase array 443 may not contribute significantly to the overall structure of the source image and therefore may or may not be copied and/or manipulated.

After selection of a region of elements at 455, the process 400 proceeds to 460, at which the processor performs an analysis of the elements in the selected region. The selected region may be in various shapes, such as an annulus, a rectangle, ellipse, or any other two-dimensional shape. Depending upon the application of different mathematical models, there may be no apriori knowledge of the magnitude values within the magnitude array selected at 445. In the present example, there is no prior knowledge of the magnitude value range or average magnitude value of the pixel in the first area, and there is no prior knowledge of how the magnitude values are distributed in the first area. However, it is envisioned that a mathematical model may be developed that allows for the selection of regions based on a model of the range or average of magnitude values, or the modeling of the distribution of array values.

At 460, a probability distribution function (PDF) is determined for the elements in the selected region of the selected array. The determination of the PDF may be accomplished in various ways, one way of which is described below with reference to FIG. 4B.

The process, at 470, uses the PDF to generate corresponding frequency domain data values at random locations within new array covered by the annular band. These generated data values are used to replace, in a random distribution, the portion of the frequency domain data set to form the manipulated frequency domain data set.

At 471, the process determines whether any other regions of the selected array are to be copied to the new array. If the previous region is not the last region (i.e., a NO determination at 471), the processor, at 473, selects a next region of higher order elements from the selected array, and steps 455, 460 and 470 are repeated for the next region. For example, a next region of higher order elements of frequency domain data values in the selected array may be a sequentially larger areas. In the earlier example, the previous annular band had an inside diameter of 100 pixels and a width of 10 pixels, the next annular band may have an inside diameter of 111 pixels and a width of 15 pixels, or the like. This process, steps 471, 473 and 455-470, may repeat for several iterations until the new array is populated with generated frequency domain data values that are randomly distributed within the particular areas of the new array portion that replace the frequency domain data values copied from the respective magnitude 442 or phase array 443. While the above process, steps 471, 473, 455-470 have been described and illustrated as sequential steps, the process steps may, in other examples, be executed in parallel or in another order.

If the determination, at 471, is YES, the process proceeds to 475 and a manipulated array of frequency domain data is generated. The manipulated array of frequency domain data may be generated, for example, by replacing the portion of the frequency domain data set with the new portion of manipulated data values from each of the selected regions to form the manipulated frequency domain data set. In an example, each new portion containing the manipulated frequency domain data of the respective selected regions may be saved to a single data array that is the manipulated array of frequency domain data for the array selected at 445. Alternatively, each new portion may be saved in a separate file until all regions or portions of the frequency domain data have been manipulated. Upon completion of the last region or portion, the respective new portions may be saved into a single file containing all of the new portions of manipulated frequency domain data for a respective array selected at 445. If the determination at 471 is NO, the processor selects another region of higher order elements from the selected array at 475A. For example, if the magnitude array was previously selected, the processor at 475A selects the phase array that corresponds to the magnitude array of the respective color channel.

After completion of random distribution of values for each magnitude and phase array in each respective color channel, the process 400 proceeds to step 480. At 480, the processor combines the generated arrays to form a manipulated frequency domain data set corresponding to the respective color channels (described in more detail below with reference to FIG. 4B). In other words, the processor combines the manipulated values of the magnitude array with the manipulated values of the phase array to provide a manipulated frequency domain data set for a complete, respective color channel image.

Once the manipulated frequency domain data set for a respective color channel is obtained, an inverse Fourier transform is applied to the respective color channel image (485). The foregoing process steps 445-485 are performed for each respective color channel of the source image. Once the respective color channels have been inverse Fourier transformed to an image data set, round off errors and other artifacts that are the result of the mathematical manipulation may be removed from image data values by the processor. After removal and general clean-up of the image data values, the manipulated image data for each of the respective color channels is combined to form a new image made up of the manipulated image data (495) from each of the color channels. The manipulated image data is stored for future use, which may be immediately, or provided directly to a display driver circuit as a new image (499).

FIG. 4B provides a graphical representation example of the resulting changes to a source image from the application of the respective steps in the process of FIG. 4A to the source image. Note that the graphical representations in FIGS. 4B and 4C depict graphical examples of the frequency domain data set generated at the steps of process 400 referenced in the respective figures, and is presented as the data may appear if presented on a display device. The graphical representations are provided for purposes of understanding the manipulation of the source image at the referenced process steps, and do not represent an output that is visible to a user of the disclosed processes or lighting systems. The graphical representations of the magnitude array 442 and the phase array 443 are provided for depicting at respective steps of the process 400 how the generated data may appear if presented on a display device. Note that the display device may not be the same as the output of a pixel matrix or a lighting system as described herein.

The processing steps described above with respect to FIG. 4A generate the magnitude array 442 and the phase array 443 by the application of the Fourier transform at 435 of FIG. 4A. Either the magnitude array 442 or the phase array 443 is selected at arrow labeled 1 (445 of FIG. 4A). In the example of FIG. 4B, the magnitude array 442 is selected. The processing of the magnitude array begins by selection of a number of frequency domain magnitude values at the center of array that are substantially the zero-th order values discussed above. The number of selected values may be any number that is the preferred number of values to provide the desired image effects. In other words, the selected number of values may be any number greater than or equal to 1, for example, 1, 7, 10, 13, 20 or the like. After selection of the zero-th order values, the selected zero-th order values are stored in memory without manipulation. Of course, the zero-th order values may be manipulated to affect the overall color temperature, if desired by a user, other person, a premises color profile, or the like that configures the disclosed system. For example, a fixture (i.e., a lighting device) may have a color temperature (CCT) profile over the course of the day, an image processor may manipulate the zero-th order elements to match the current position (e.g., at a particular time of day) on the CCT profile. Returning to the illustrated process, the magnitude array is selected at step 445, and the process 400 transitions (Arrow labeled 2) to step 455 at a region of elements in the selected magnitude array are selected for statistical frequency domain image processing. The selected region of elements may have any shape, such as a square, a diamond or other geometric shape. The selected region shown in FIG. 4B, is an annular ring. The annular ring has a certain inside diameter and width that includes a range of data values within the boundaries of the annular ring. The width of the selected areas allows for greater variation of output image, where a narrower width of the selected region the more structure of the source image is retained, while a wider width reduces the amount of structure retained from the source image. The more structure an output image has the less abstract, the output image is with respect to the source image.

Following the arrow labeled 3, the steps 460 and 470 are explained with reference to the graphs. Continuing with our example, in order to find a PDF suitable for delivering a user's or system administrator's desired output, a histogram of magnitude values in the selected region is taken. The histogram has a count and magnitude axes. Note that the illustrated histogram is for illustration purposes only and the respective magnitude and count values are examples only and may not be representative of actual image data. The processor identifies the magnitude values of the elements in the selected region and the number of elements having the identified magnitude values, which may be presented as shown in the illustrated histogram. A purpose of step 460 is to recreate the magnitude values in the selected region with a similar magnitude value distribution (e.g., approximately 25 location values with a magnitude of approximately 25, approximately 16 location values with a magnitude of approximately 26, and so on for the entire first area), but different values at different locations within the first area. In other words, the approximately 16 of the approximate 25 location values of approximately magnitude 25 may have been on one side of the selected region, the purpose is to randomly distribute those approximately 16 plus the other approximately 9 location values of approximately magnitude 25 throughout a similar first area as the selected region.

This may be accomplished by using the PDF in a suitable pseudo-random number generator to generate new values for the selected region. Note that the PDF graph like the histogram graph has a magnitude axis and a probability axis. Other examples of methods for finding a PDF may include fitting the parameters of a known distribution function to the data extracted from Step 455. In example, the generated magnitude value for a given location may be substantially the same as the original magnitude value at that given location.

Following the arrow labeled 4, the PDF may be determined for data values in the portion of the frequency domain data set identified by the first area. A PDF may be obtained based on historical data related to the subject of the initial, or source, image, for example, multiple different images of a yellow flower may have an average distribution of frequency domain data values, while different images of a street scene may have different average distributions of frequency domain values. Once the PDF is determined, the PDF is used with a suitable pseudo-random number generator to generate new data values for the portion of the frequency domain data set of identified by the first area.

An example of the application of the PDF is a best fit approximation, although other curve-fitting approximations may be used such as least-squares or the like. Once the "best fit' is identified, a suitable pseudo-random number generator generates data values for the new array in accordance with the determined probability distribution function. Since the application of the PDF via a best fit process, the exact number of certain magnitude values in the histogram may not be the same in the new array as in the selected array. For example, the 25 locations having a location value of magnitude 25 may now have, for example, a quantity of 23 or 24 locations of magnitude 25.

Once the PDF is determined, the individual locations within the selected region are repopulated using values output from, for example, a pseudo-random number generator that generates values within the range of the data values that appeared in region selected at step 455. As shown in the image labeled "Output at Step 470," the repopulated data values of the selected region may be stored in memory, or may be stored with other manipulated arrays as shown by the arrow labeled 6. After the selected region is processed, the process returns to Step 471.

At the top of FIG. 4B is a graphical representation of phase array data being manipulated by the process of FIG. 4A as described above with reference to FIG. 4B.

To further assist with the explanation of the above described image structure processing, FIG. 4C provides a high-level graphical representation of the process of FIG. 4A. In FIG. 4C, the color channel data from step 420 of FIG. 4A may be presented as separate color channel images. Although shown as grayscale in FIG. 4C, each of the red, green, blue color channel images show different levels of detail of the source image.

In the example, one of red, green or blue color channel data arrays selected (at 425 in FIG. 4A and shown as A in FIG. 4C) is transformed using a Fourier transform. The results of the Fourier transform result in a magnitude array and a phase array, which if presented on a display device may appear as shown in B of FIG. 4C. For example, at B, the magnitude array may appear as the graphic labeled "Magnitude before" and the phase array may appear as the graphic labeled "Phase before." In the example process 400 of FIG. 4C, the phase array at B is manipulated according to steps 445-475 of FIG. 4A. At C, the manipulated data of the magnitude array may appear as the graphic labeled "Magnitude after" and the phase array may appear as the graphic labeled "Phase after." The respective magnitude and phase array are recombined using, for example, for each position denoted by indices (s,t), the arrays would be combined using the form: $F(s,t)=\text{Magnitude}(s,t)\times e^{i\times Phase(s,t)}$. Where $e^{i\times Phase(s,t)}$ is Napier's constant raised to the power of i*Phase(s,t) and i is the imaginary constant (i.e., square root of −1). After application of the inverse Fourier transform, the respective red, green and blue color channels formed from the manipulated phase array data values may appear, if presented on a display device, as shown in D of FIG. 4C. A comparison of, for example, the green color channel in A to the green color channel in D shows the abstraction of the source image green color channel in the manipulated green color channel. A similar abstraction of detail is evident in the manipulated red and manipulated blue color channels as compared to the source image red and source image blue color channels, respectively. As a result of the process illustrated in the flow chart of FIG. 4A, the regenerated and/or outputted manipulated image is more abstract than the source image. In other words, the manipulated image still includes the details of the source image, but by manipulating the magnitude and/or the phase components of the frequency domain data set by scrambling, or randomizing, the manipulated image when presented appears as an abstraction of the source image. As a result, the subject matter of the manipulated image when presented is not as visually recognizable as being the same subject matter as presented in the source image.

As noted earlier, frequency domain manipulation may be implemented in a processor in a lighting device or closely associated with a lighting device (e.g. in proximity); or the frequency domain manipulation may be implemented in a remote computer that sends the resulting image data file to a controller of or associated with a lighting device. Also, some number of lighting devices in a lighting system may be controlled in a similar manner within one premises or even in one illuminated area. Where the lighting devices illuminate one area, the image files used to control the lighting devices may be the same or may be interrelated, e.g. portions of a larger image. To appreciate some of these related concepts, it may be helpful to consider a multi-device lighting system as well as network communications thereof including communications with external computers/processors.

Figure 5:
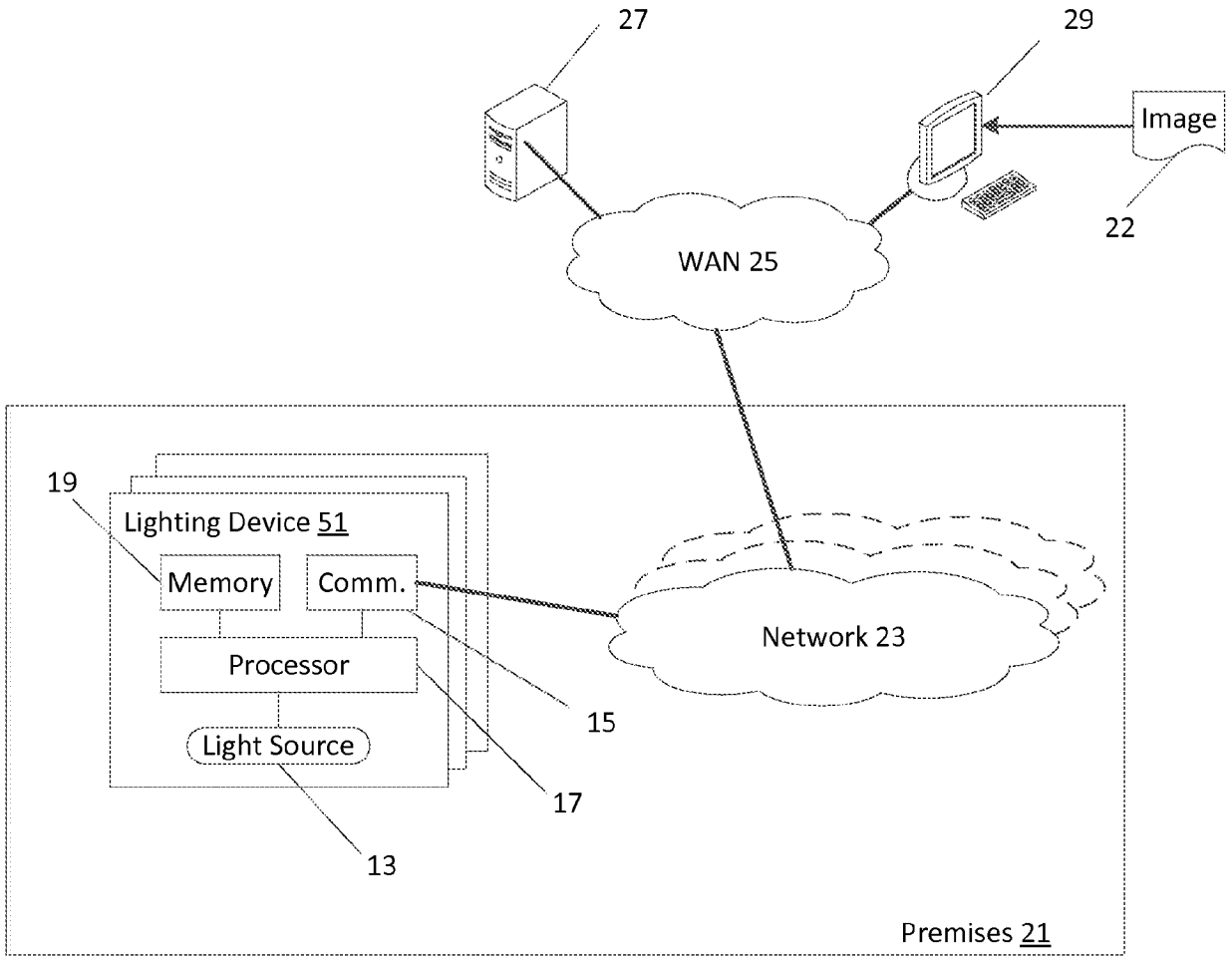
FIG. 5 illustrates a functional block diagram example of a system for implementing the described frequency domain image processing examples.

FIG. 5 illustrates an example of a network multi-device lighting system 10 in block diagram form. The illustrated example of the system 10 includes a number of intelligent lighting devices 51, such as fixtures or lamps or other types of luminaires that are for providing lighting and/or image display.

The term "lighting device" as used herein is intended to encompass essentially any type of device that processes power to generate light, for example, for illumination of and to present imagery in a space intended for use by occupants that can take advantage of or be affected in some desired manner by the light emitted from the device. In addition, the lighting device is configured to present image data for eliciting a desired response from occupants of the space. The desired response may be somewhat psychologically soothing or may encourage workers' job performance in the illuminated space. However, the present technology may produce other effects, for example, to encourage people visiting or passing through a space not to linger an inordinate amount of time.

The lighting device 51, for example, may take the form of a lamp, lamp shade, light fixture or other luminaire that incorporates a light source, where the light source by itself contains no intelligence (i.e., no image processing functionality), but are capable of generating different color channels of light (e.g. LEDs or the like). In most examples, the lighting device(s) 51 illuminate a service area to a level useful for a human in or passing through the space, e.g. regular illumination of a room, an area or corridor in a building or of an outdoor space such as a street, sidewalk, parking lot or performance venue.

Each respective intelligent lighting device 51 includes a light source 13, a communication interface 15 and a processor 17 coupled to control the light source 13. The light sources may be virtually any type of pixel matrix light source suitable for providing illumination that may be electronically controlled and provide a number of different color channels. The light may be of the same general type in all of the lighting devices, e.g. all formed by some number of light emitting diodes (LEDs); although in many installations, some number of the lighting devices 51 may have different types of light sources 13.

The processor 17 also is coupled to communicate via the interface 15 and the network link with one or more others of the intelligent lighting devices 51 and is configured to control operations of at least the respective lighting device 51. The processor may be implemented via hardwired logic circuitry, but in the examples, the processor 17 is a programmable processor such as a central processing unit (CPU) of a microcontroller or a microprocessor. Hence, in the example of FIG. 5, each lighting device 51 also includes a memory 19, storing programming for execution by the processor 17 and data that is available to be processed or has been processed by the processor 17.

In the examples, the intelligence (e.g. processor 17 and memory 19) and the communications interface(s) 15 are shown as integrated with the other elements of the lighting device or attached to the fixture or other element that incorporates the light source. However, for some installations, the light source 13 may be attached in such a way that there is some separation between the fixture or other element that incorporates the electronic components that provide the intelligence and communication capabilities. For example, the communication component(s) and possibly the processor and memory (the 'brain') may be elements of a separate device or component coupled and/or collocated with the light source 13.

In our example, the system 10 is installed at a premises 21. The system 10 also includes a data communication network 23 that interconnects the links to/from the communication interfaces 15 of the lighting devices 51, so as to provide data communications amongst the intelligent lighting devices 51. Such a data communication network 23 also is configured to provide data communications for at least some of the intelligent lighting devices 51 via a data network 25 outside the premises 21, shown by way of example as a wide area network (WAN), so as to allow devices 51 or other elements/equipment at the premises 21 to communicate with outside devices such as the server/host computer 27 and the user terminal device 29. The wider area data network 25 outside the premises, may be an intranet or the Internet, for example. Alternatively, servers of the data network 25 and/or other elements described above may be located at the premises 21.

Also, although the examples in FIG. 5 show most of the lighting devices 51 having one communication interface, some or all of the lighting devices 51 may have two or more communications interfaces to enable data communications over different media with the network(s) and/or with other devices in the vicinity.

The overall premises network, generally represented by the cloud 23 in the drawing, encompasses the data links to/from individual devices 51 and any networking interconnections within respective areas of the premises where the devices 51 are installed as well as the LAN or other premises-wide interconnection and associated switching or routing. In many installations, there may be one overall data communication network 23 at the premises 21. However, for larger premises and/or premises that may actually encompass somewhat separate physical locations, the premises-wide network may actually be built of somewhat separate but interconnected physical networks represented by the dotted line clouds. The LAN or other data network forming the backbone of a system network 23 at the premises 21 may be a data network installed for other data communications purposes of the occupants; or the LAN or other implementation of the network 23, may be a data network of a different type installed substantially for lighting system use and for use by only those other devices at the premises that are granted access by the lighting system elements (e.g. by the lighting devices 51).

Hence, there typically will be data communication links within a room or other service area as well as data communication links from the lighting devices 51 in the various rooms or other service areas out to wider network(s) forming the data communication network 23 or the like at the premises 21. Devices 51 within a service area can communicate with each other, with devices 51 in different rooms or other areas, and in at least some cases, with equipment such as 27 and 29 that are configured as image processors and located outside the premises 21. For example, the devices 27 and/or 29 may provide the source image 22 for frequency domain image processing by a processor, such as 17 in a lighting device 51.

In another example, the system network 23 or lighting device 51 may allow for manipulation of the presented image based on a learning capability that enables lighting system to learn what is a typical occupancy period, e.g., 9 am-5 pm, 12 am-6 am, different time intervals (e.g., 1 hour in the morning and 2 hours in the evening, etc.) within 24 hour day, or the like, for a given space in the premises 21. Based on the learned occupancy period, the lighting device, the network 23 or the lighting device 51 is able to change some implementation detail regarding the presentation, such as, for example, the speed of the image transition, the display brightness, the image color palette, or other parameters of the display accordingly.

Various network links within a service area, amongst devices in different areas and/or to wider portions of the network 23 may utilize any convenient data communication media, such as power lines wiring, separate wiring such as coax or Ethernet cable, optical fiber, free-space optical, or radio frequency wireless (e.g. Bluetooth or WiFi); and a particular premises 21 may have an overall data network 23 that utilizes combinations of available networking technologies. Some or all of the network communication media may be used by or made available for communications of other gear, equipment or systems within the premises 21. For example, if combinations of WiFi and wired or fiber Ethernet are used for the lighting system communications, the WiFi and Ethernet may also support communications for various computer and/or user terminal devices that the occupant(s) may want to use in the premises. The data communications media may be installed at the time as part of installation of the lighting system 10 at the premises 21 or may already be present from an earlier data communication installation. Depending on the size of the network 23 and the number of devices and other equipment expected to use the network 23 over the service life of the network 23, the network 23 may also include one or more packet switches, routers, gateways, etc.

A host computer or server like 27 can be any suitable network-connected computer, tablet, mobile device or the like programmed to implement desired network-side functionalities. Such a device may have any appropriate data communication interface to link to the WAN 25. Alternatively or in addition, a host computer or server similar to 25 may be operated at the premises 21 and utilize the same networking media that implements data network 23.

The user terminal equipment such as that shown at 29 may be implemented with any suitable processing device that can communicate and offer a suitable user interface. The terminal 29, for example, is shown as a desktop computer with a wired link into the WAN 25. However, other terminal types, such as laptop computers, notebook computers, netbook computers, and smartphones may serve as the user terminal computers. Also, although shown as communicating via a wired link from the WAN 25, such a user terminal device may also or alternatively use wireless or optical media; and such a device may be operated at the premises 21 and utilize the same networking media that implements data network 23.

For various reasons, the communications capabilities provided at the premises 21 may also support communications of the lighting system elements with user terminal devices and/or computers (not shown) within the premises 21. The user terminal devices and/or computers, such as 27 and 29, within the premises 21 may use communications interfaces and communications protocols of any type(s) compatible with the on-premises networking technology of the system 10. Such communication with a user terminal, for example, may allow a person in one part of the premises 21 to communicate with a lighting device 51 in another area of the premises 21, to provide source images, such as image 22 and/or to control lighting or other system operations, such as application of the image processes described herein in the other area. In addition or alternatively, a program or policy may determine the source images to be provided, such as, for example, images might be tailored to the occupants' needs/likes/aesthetic on a fixture by fixture or area by area basis. The image 22 may be one or more video frames in a sequence of video frames obtained from a video stream representation of a scene or object, or may be one or more still image frames of one or more scenes and/or objects.

The external elements, represented generally by the server/host computer 27 and the user terminal device 29, which may communicate with the intelligent elements of the system 10 at the premises 21, may be used by various entities and/or for various purposes in relation to operation of the lighting system 10 and/or to provide information or other services to users within the premises 21, e.g. via the interactive user interface portal offered by the lighting devices 51.

For example, the user terminal device 29 may receive a source image, such as image 22, from a connected device, such as a camera, smartphone, video camera or the like. In addition or alternatively, the user terminal device 29 may be configured to generate a source image, such as image 22, using computer programming executed by the user terminal device. The generated source image may include a number of color channel image domain data arrays.

The processors of devices 27 and 29, in some examples, are configured (e.g. programmed in our example) to perform the above described frequency domain image processing of the received source image. For example, the user terminal device 29 may be configured with an image processor (not shown) that executes the transformation of the source image into a frequency domain data set, the manipulation of the frequency domain data set as discussed above, and the inverse transformation of the manipulated frequency domain data set into an image domain data set. The image processor of user terminal device 29 may store the image domain data set as an image file that is to be provided to the lighting device 51. The user terminal device 29 may provide the image file to the lighting device 51 communication interface 15 via the WAN 25 and the network 23. Upon receipt of the image file, the processor 17 of the lighting device 51 causes the light source 13 to present the image of the image file to the users in the premises 21.

In another example, the device 27 may be configured as an image processor (not shown) and may receive a source image, such as image 22, from a user terminal 29 via the WAN 25. The image processor of device 27 executes the transformation of the source image into a frequency domain data set, the manipulation of the frequency domain data set as discussed above, and the inverse transformation of the manipulated frequency domain data set into an image domain data set. The image processor of device 27 may return the generated image domain data set as an image file to the user terminal 29. The user terminal 29 in response to user inputs may provide via the WAN 25 and network 23 the image file to lighting device 51 for output by the light source 13.

In another example, the image processor may be distributed between one or more of user terminal 29, device 27 and processor 17. In such an example, different aspects of the above described frequency domain image processing may be performed by the different devices. For example, transformation of the source image into frequency domain data may be performed by the device 27, and the manipulation of the frequency domain data may be performed by a user (or performed automatically according to user preferences stored by terminal 29), and the manipulated frequency domain data may be forwarded to the respective lighting devices 51 for inverse transformation by the processor 17, and presentation of the image data via the light source 13. Of course, other distribution scenarios are envisioned. In this example, the processing of source images is discussed as being performed by the respective processors of devices 27 and 29; however, in other examples, it is envisioned that the processing of the source image is performed by the processor 17 of the lighting device 51. As the processor 17 executes the frequency domain image processing of the source image as described above, the processor 17 sends signals representative of the image data to a driver (as explained with reference to FIG. 1 above) connected to the light source 13. For example, the premises 21 may be equipped with multiple lighting devices 51 that form a group of lighting devices. As another alternative, the group of lighting devices 51 can be used in a distributed processing fashion to transform the source image (for examples using a source image), manipulate data in the frequency domain and inverse-transform the manipulated data to produce one or more image files to drive pixel matrices of the lighting devices. In such an example, this frequency domain image processing may not be in real time, but may be applied to a previously provided, stored image or to a computer generated image in non-real time (e.g. overnight) for use to drive light device outputs when the image data processing is completed. In the above examples, one or more of the devices may function as the image processor 45 referenced in FIG. 1.

The devices 27 and/or 29 may also be configured to control lighting operations, for example, to control the light sources 13 of such devices 51 in response to commands received via the network 23 and the communication interfaces 15.

In addition or alternatively, the lighting device 51 is one of a number lighting devices in an area that are configured to cooperate with one another. The number of lighting devices 51 may be configured such that the light source 13 of each of the number of lighting devices 51 is adjacent to a light source of another lighting device 51 to form a large light source. In other words, there is a group of lighting devices 51. In such a group, the individual lighting devices 51 only need to present a portion of a manipulated image. Also, the respective lighting device 51 only has to process the portion of the source image that the respective lighting device 1 is assigned to present via its light source 13. The control of the assignment of respective image portions to the lighting devices 51 in the group may be provided by a "master" lighting device 51 that controls the group.

The light sources 13 are constructed as a pixel matrix of light emitters, such as a number of LEDs of different colors, such as RGB, RGBW or the like as described with reference to FIG. 1.

As shown by the above discussion, functions relating to the image processing particularly in the frequency domain may be implemented on computers connected for data communication via the components of a packet data network, operating as a user terminal, a lighting device and/or as a server as shown in FIG. 5. Although special purpose devices may be used, such devices also may be implemented using one or more hardware platforms intended to represent a general class of data processing device commonly used to run "server" programming so as to implement the image processing particularly in the frequency domain and image presentation functions discussed above, albeit with an appropriate network connection for data communication.

As known in the data processing and communications arts, a general-purpose computer typically comprises a central processor or other processing device, an internal communication bus, various types of memory or storage media (RAM, ROM, EEPROM, cache memory, disk drives etc.) for code and data storage, and one or more network interface cards or ports for communication purposes. The software functionalities involve programming, including executable code as well as associated stored data, e.g. files used for the frequency domain image processing and source images. The software code is executable by the general-purpose computer if configured to function as the image processor and/or that functions as a user terminal device for any relevant input output or image processing functions particularly in the frequency domain. In operation, the code is stored within the general-purpose computer platform. At other times, however, the software may be stored at other locations and/or transported for loading into the appropriate general-purpose computer system. Execution of such code by a processor of the computer platform enables the platform to implement the methodology for the frequency domain processing of an image for driving a multi-pixel lighting device, in essentially the manner performed in the implementations discussed and illustrated herein.

Figure 6:
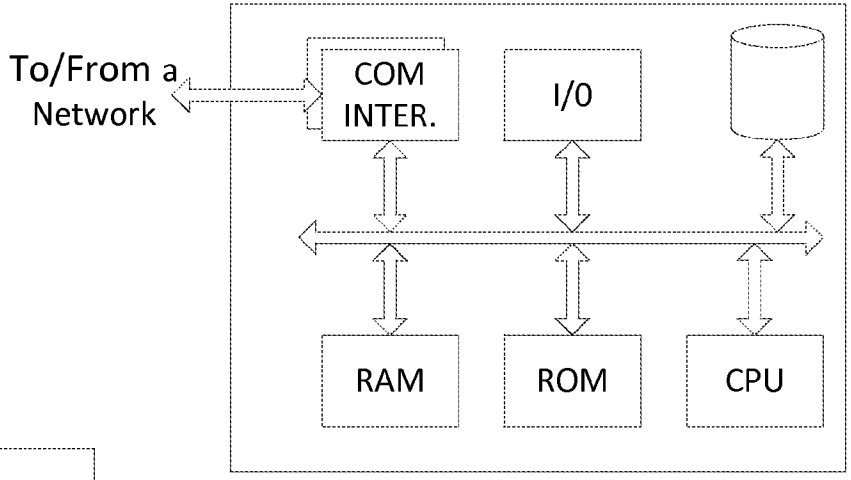
FIG. 6 is a simplified functional block diagram of a computer that may be configured as a processor or server, for example, to function as the processor in the lighting device of FIG. 1, or the user terminal 29 or server 27 of the system of FIG. 5.
Figure 7:
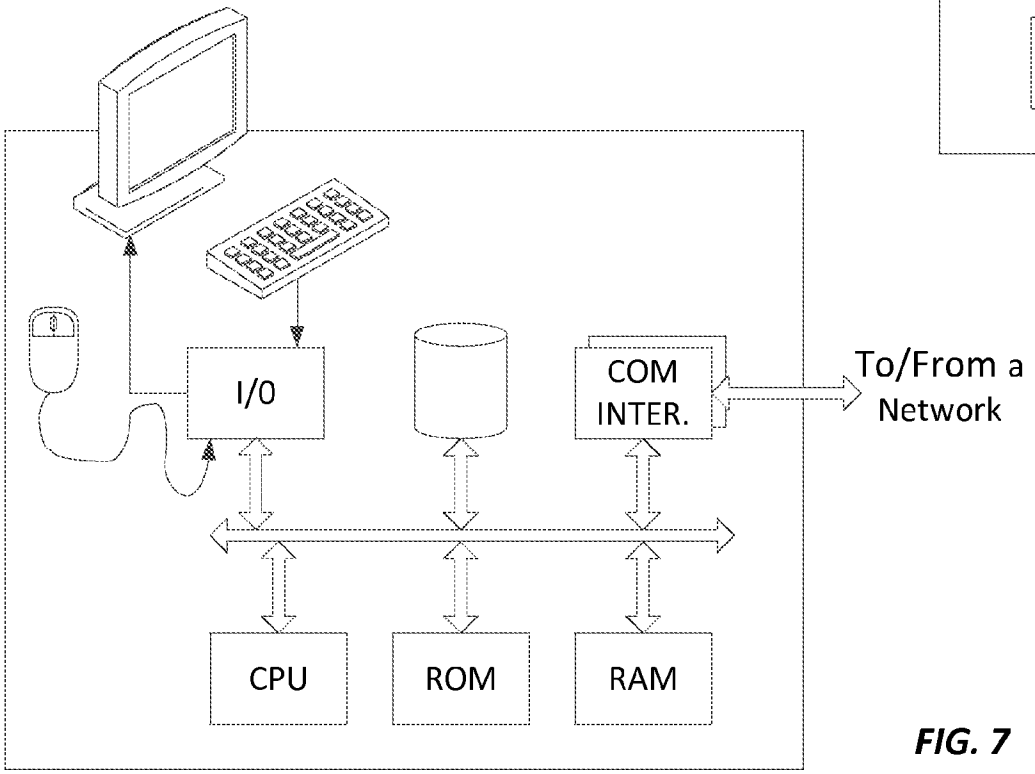
FIG. 7 is a simplified functional block diagram of a personal computer or other work station or terminal device.

FIGS. 6 and 7 provide functional block diagram illustrations of general purpose computer hardware platforms. FIG. 6 illustrates a network or host computer platform, as may typically be used to implement a server. FIG. 7 depicts a computer with user interface elements, as may be used to implement a personal computer or other type of work station or terminal device, although the computer of FIG. 7 may also act as a server if appropriately programmed. It is believed that those skilled in the art are familiar with the structure, programming and general operation of such computer equipment and as a result the drawings should be self-explanatory.

A server computer, for example (FIG. 6), includes a data communication interface for packet data communication (COM INTER.). The server computer also includes circuitry of one or more processors forming a central processing unit (CPU), for executing server programming and/or any other appropriate program instructions. The server platform typically includes program storage and data storage as well as an internal communication bus, enabling the processor(s) of the CPU to access programming instructions and/or various data files to be processed and/or communicated by the server. For execution, the programming for the processor(s) typically resides in one or more of the storage devices and is loaded as needed into working memory in or otherwise available for use by the processor(s), although the server computer often receives programming and data via network communications and the relevant communication interface(s). The hardware elements, operating systems and programming languages of such server computers are conventional in nature, and it is presumed that those skilled in the art are adequately familiar therewith. Of course, the server functions may be implemented in a distributed fashion on a number of similar computer platforms, to distribute the processing load.

A computer type user terminal device, such as a PC or tablet computer, similarly includes a data communication interface, processor circuitry for a CPU, main memory and one or more mass storage devices accessible to the CPU for storing user data and the various executable programs (see FIG. 7). A mobile device type user terminal may include similar elements, but will typically use smaller components that also require less power, to facilitate implementation in a portable form factor. A computer type device often will include an internal bus similar to that of the server computer (as also shown in FIG. 7). The various types of user terminal devices will also include various user input and output elements. A computer, for example, may include a keyboard and a cursor control/selection device such as a mouse, trackball, joystick or touchpad; and a display for graphical outputs. A microphone and speaker enable audio input and output. The hardware elements, operating systems and programming languages of such user terminal devices also are conventional in nature, and it is presumed that those skilled in the art are adequately familiar therewith.

Hence, aspects of the methods of modifying the image outlined above may be embodied in programming. Program aspects of the technology may be thought of as "products" or "articles of manufacture" typically in the form of executable code and/or associated data that is carried on or embodied in a type of machine readable medium. "Storage" type media include any or all of the tangible memory of the computers, processors or the like, or associated modules thereof, such as various semiconductor memories, tape drives, disk drives and the like, which may provide non-transitory storage at any time for the software programming. All or portions of the software may at times be communicated through the Internet or various other telecommunication networks. Such communications, for example, may enable loading of the software from one computer or processor into another, for example, from a management server or host computer of the system owner into the computer platform of the premises that will be the image server. Thus, another type of media that may bear the software elements includes optical, electrical and electromagnetic waves, such as used across physical interfaces between local devices, through wired and optical landline networks and over various air-links. The physical elements that carry such waves, such as wired or wireless links, optical links or the like, also may be considered as media bearing the software. As used herein, unless restricted to non-transitory, tangible "storage" media, terms such as computer or machine "readable medium" refer to any medium that participates in providing instructions to a processor for execution.

Hence, a machine readable medium may take many forms, including but not limited to, a tangible storage medium, a carrier wave medium or physical transmission medium. Non-volatile storage media include, for example, optical or magnetic disks, such as any of the storage devices in any computer(s) or the like, such as may be used to implement the lighting device frequency domain image processing and image driving system etc. shown in the drawings. Volatile storage media include dynamic memory, such as main memory of such a computer platform. Tangible transmission media include coaxial cables; copper wire and fiber optics, including the wires that comprise a bus within a computer system. Carrier-wave transmission media can take the form of electric or electromagnetic signals, or acoustic or light waves such as those generated during radio frequency (RF) and infrared (IR) data communications. Common forms of computer-readable media therefore include for example: a floppy disk, a flexible disk, hard disk, magnetic tape, any other magnetic medium, a CD-ROM, DVD or DVD-ROM, any other optical medium, punch cards paper tape, any other physical storage medium with patterns of holes, a RAM, a PROM and EPROM, a FLASH-EPROM, any other memory chip or cartridge, a carrier wave transporting data or instructions, cables or links transporting such a carrier wave, or any other medium from which a computer can read programming code and/or data. Many of these forms of computer readable media may be involved in carrying one or more sequences of one or more instructions to a processor for execution.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," "includes," "including," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

Unless otherwise stated, any and all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present concepts.

What is claimed is:

1. A lighting system, comprising:

a pixel matrix of light emitters configured to illuminate an area, each light emitter at a respective pixel of the matrix comprising a source of light configured to be controlled to vary a characteristic of light emitted from the respective pixel;

a driver circuit connected to the pixel matrix and configured to control the light emitters at the pixels of the matrix responsive to an image input; and an image data processor configured to implement functions, including functions to:

obtain a frequency domain data set corresponding to an image;

manipulate at least one aspect of the frequency domain data set to reduce a level of detail of the image, the manipulation forming a manipulated frequency domain data set;

transform the manipulated frequency domain data set into an image domain data set; and supply the image input for use by the driver circuit, based at least in part on the image domain data set;

wherein the lighting system is a luminaire.

2. The lighting system of claim 1, wherein:

the image data processor functions further include functions to:

obtain another frequency domain data set, corresponding to another image;

manipulate at least one aspect of the other frequency domain data set to form another manipulated frequency domain data set; and combine the manipulated frequency domain data sets together; and the processor function to transform comprises a function to transform the combination of the manipulated frequency domain data sets into the image domain data set.

3. The lighting system of claim 1, wherein the image data processor function to manipulate at least one aspect of the frequency domain data set comprises functions to:

for a portion of the frequency domain data set, determine a probability distribution function for data values in the portion of the frequency domain data set;

generate data values in accordance with the determined probability distribution function; and construct a new portion containing the generated data values at random locations in the new portion; and replace the portion of the frequency domain data set with the new portion, to forming the manipulated frequency domain data set.

4. The lighting system of claim 1, wherein:

(a) the processor function to obtain the frequency domain data set includes functions to:

Fourier transform a source image;

from the Fourier transform, form the frequency domain data set comprising:

a first array of magnitude terms for frequency components from the Fourier transform of the source image, and a second array of phase terms for frequency components from the Fourier transform of the source image;

(b) the processor function to manipulate at least one aspect of the frequency domain data set comprises:

for a portion of the first array, determine a probability distribution function for magnitude terms in the portion of the first array;

generate data values in accordance with the determined probability distribution function for magnitude terms;

construct a new first array portion containing the generated data values at random locations in the new first array portion, as new magnitude terms;

replace the portion of the first array with the new first array portion, to form a first manipulated array of magnitude terms for frequency components;

for a portion of the second array, determine a probability distribution function for phase terms in the portion of the second array;

generate data values for phase terms in accordance with the determined probability distribution function for phase terms;

construct a new second array portion containing the generated data values for phase terms at random locations in the new second array portion, as new magnitude terms; and replace the portion of the second array with the new second array portion, to form a second manipulated array of phase terms for frequency components; and (c) the processor function to transform the manipulated frequency domain data set comprises a function to implement an inverse-Fourier transform on the first and second manipulated arrays.

5. The lighting system of claim 1, wherein the image domain data set produced by the transformation of the manipulated frequency domain data set lacks at least some details of the image represented by the frequency domain data set.

6. The lighting system of claim 1, wherein the pixel matrix is further configured as an output an image that is a blurred version of the image to which the obtained frequency domain data set corresponds.

7. A lighting system, comprising:

a pixel matrix of light emitters, each light emitter at a respective pixel of the matrix comprising a source of light configured to be controlled to vary a characteristic of light emitted from the respective pixel;

a driver circuit connected to the pixel matrix and configured to control the light emitters at the pixels of the matrix responsive to an image input; and an image data processor configured to implement functions, including functions to:

Fourier transform a source image; and from the Fourier transform, form a frequency domain data set corresponding to the source image, the frequency domain data set comprising:

an array of magnitude terms for frequency components from the Fourier transform of the source image, and an array of phase terms for frequency components from the Fourier transform of the source image;

obtain the frequency domain data set corresponding to an image;

manipulate at least one aspect of the frequency domain data set by masking out terms from the array of phase terms for frequency components from the Fourier transform of the source image exhibiting a predetermined characteristic;

transform the manipulated frequency domain data set into an image domain data set; and supply the image input for use by the driver circuit, based at least in part on the image domain data set.

8. A lighting system, comprising:

a pixel matrix of light emitters, each light emitter at a respective pixel of the matrix comprising a source of light configured to be controlled to vary a characteristic of light emitted from the respective pixel;

a driver circuit connected to the pixel matrix and configured to control the light emitters at the pixels of the matrix responsive to an image input; and an image data processor configured to implement functions, including functions to:

obtain a frequency domain data set corresponding to an image by:

separating a color characteristic image from a source image, a color characteristic corresponding to a respective one of a plurality of color channels of the light emitters of the pixel matrix; and for the color characteristic image:

applying a transformation to the color characteristic image;

from the transformed color characteristic image, forming a different frequency domain data set, comprising:

a first array of magnitude terms for frequency components from the transformed color characteristic image, and a second array of phase terms for frequency components from the transformed color characteristic image;

manipulate at least one aspect of the frequency domain data set to form a manipulated frequency domain data set;

transform the manipulated frequency domain data set into an image domain data set; and supply the image input for use by the driver circuit, based at least in part on the image domain data set.

9. The lighting system of claim 8, wherein:

the image data processor function to manipulate at least one aspect of the frequency domain data set comprises manipulating at least one of the first and second arrays of terms for frequency components from the transformed color characteristic image to form the manipulated frequency domain data set; and the image data processor function to transform the manipulated frequency domain data set comprises inverse transformation functions that apply an inverse transformation to first and second arrays of terms for the color characteristic image including the at least one manipulated array for the color characteristic image, to form a separate image domain data set for the respective one of the plurality of color channels of the light emitters of the pixel matrix.

10. A lighting system, comprising:

a pixel matrix of light emitters, each light emitter at a respective pixel of the matrix comprising a source of light configured to be controlled to vary a characteristic of light emitted from the respective pixel;

a driver circuit connected to the pixel matrix and configured to control the light emitters at the pixels of the matrix responsive to an image input; and an image data processor configured to implement functions, including functions to:

obtain a frequency domain data set corresponding to an image by:

separating a source image into a plurality of different color characteristic images, each different color characteristic corresponding to a respective one of a plurality of color channels of the light emitters of the pixel matrix; and for each different color characteristic image:

Fourier transforming the different color characteristic image;

from the Fourier transform of the different color characteristic image, forming a different frequency domain data set comprising:

a first array of magnitude terms for frequency components from the Fourier transform of the different color characteristic image, and a second array of phase terms for frequency components from the Fourier transform of the different color characteristic image;

manipulate at least one aspect of the frequency domain data set to form a manipulated frequency domain data set;

transform the manipulated frequency domain data set into an image domain data set; and supply the image input for use by the driver circuit, based at least in part on the image domain data set.

11. The lighting system of claim 10, wherein:

the image data processor function to manipulate at least one aspect of the frequency domain data set comprises manipulating at least one of the first and second arrays of terms for frequency components from the Fourier transform of each different color characteristic image to form the manipulated frequency domain data set; and the image data processor function to transform the manipulated frequency domain data set comprises inverse transform functions to inverse Fourier transform first and second arrays of terms for each different color characteristic image including the at least one manipulated array for each different color characteristic image, to form a separate image domain data set for each respective one of the color channels of the light emitters of the pixel matrix.

12. A machine, comprising:

a communication interface;

a processor coupled to the interface;

a storage device connected to be accessible to the processor; and a program in the storage device, wherein execution of the program by the processor configures the machine to perform functions, including functions to:

obtain a frequency domain data set corresponding to an image;

manipulate at least one aspect of the frequency domain data set to reduce a level of detail of the image, the manipulation forming a manipulated frequency domain data set;

transform the manipulated frequency domain data set into an image domain data set; and transmit an image, based at least in part on the image domain data set, via the interface and through a communication network, to one or more multi-pixel lighting devices, wherein the one or more multi-pixel lighting devices:

illuminate an area, and are in one or more luminaires.

13. A method, comprising steps of:

obtaining by a processor a frequency domain data set corresponding to an image;

manipulating by the processor at least one aspect of the frequency domain data set to reduce a level of detail of the image, the manipulating step forming a manipulated frequency domain data set;

transforming by the processor the manipulated frequency domain data set into an image domain data set;

producing an image file for controlling operation of a multi-pixel lighting device, based at least in part on the image domain data set; and illuminating, by the multi-pixel lighting device, an area, wherein the multi-pixel lighting device is in a luminaire.

14. The method of claim 13, wherein the step of obtaining the frequency domain data set includes the processor:

separating a source image into a plurality of different color characteristic images, each different color characteristic corresponding to a respective one of a plurality of color control channels of the light emitters of the pixel matrix; and for each different color characteristic image:

Fourier transforming the different color characteristic image;

from the Fourier transform of the different color characteristic image, forming a different frequency domain data set comprising:

a first array of magnitude terms for frequency components from the Fourier transform of the different color characteristic image, and a second array of phase terms for frequency components from the Fourier transform of the different color characteristic image.

15. The method of claim 14, wherein:

the step of manipulating at least one aspect of the frequency domain data set comprises manipulating at least one of the first and second arrays of terms for frequency components from the Fourier transform of each different color characteristic image to form the manipulated frequency domain data set; and the step of transforming the manipulated frequency domain data set comprises inverse-Fourier transforming first and second arrays of terms for each different color characteristic image including the at least one manipulated array for each different color characteristic image, to form a separate image domain data set for each respective one of the color control channels of the light emitters of the pixel matrix.

16. The method of claim 13, further comprising the processor:

obtaining another frequency domain data set, corresponding to another image;

manipulating at least one aspect of the other frequency domain data set to form another manipulated frequency domain data set; and combining the manipulated frequency domain data sets together;

wherein the step of transforming comprises the processor transforming the combination of the manipulated frequency domain data sets into the image domain data set.

17. The method of claim 13, wherein the step of manipulating at least one aspect of the frequency domain data set comprises the processor:

for a portion of the frequency domain data set, determining a probability distribution function for data values in the portion of the frequency domain data set;

generating data values in accordance with the determined probability distribution function;

constructing a new portion containing the generated data values at random locations in the new portion; and replacing the portion of the frequency domain data set with the new portion, to form the manipulated frequency domain data set.

18. The method of claim 13, wherein:

(a) the step of obtaining the frequency domain data set includes functions to:

Fourier transforming a source image;

from the Fourier transform, forming the frequency domain data set comprising:

a first array of magnitude terms for frequency components from the Fourier transform of the source image, and a second array of phase terms for frequency components from the Fourier transform of the source image;

(b) the step of manipulating at least one aspect of the frequency domain data set comprises:

for a portion of the first array, determining a probability distribution function for magnitude terms in the portion of the first array;

generating data values in accordance with the determined probability distribution function for magnitude terms;

constructing a new first array portion containing the generated data values at random locations in the new first array portion, as new magnitude terms;

replacing the portion of the first array with the new portion, to form a first manipulated array of magnitude terms for frequency components;

for a portion of the second array, determining a probability distribution function for phase terms in the portion of the second array;

generating data values for phase terms in accordance with the determined probability distribution function for phase terms;

constructing a new second array portion containing the generated data values for phase terms at random locations in the new second array portion, as new magnitude terms; and replacing the portion of the second array with the new second array portion, to form a second manipulated array of phase terms for frequency components; and (c) the step of transforming the manipulated frequency domain data set comprises an inverse-Fourier transformation processing of the first and second manipulated arrays.

19. The method of claim 13, further comprising transmitting the image file, through a communication network, to one or more multi-pixel lighting devices.

20. An article of manufacture, comprising:

a non-transitory machine readable medium; and an executable program in the medium to configure a processor to implement the steps of the method of claim 13.

21. An article of manufacture, comprising:

an image file produced by the method of claim 13; and a non-transitory machine readable medium bearing the image file.

22. A method, comprising steps of:

obtaining by a processor a frequency domain data set corresponding to an image by:

Fourier transforming a source image; and from the Fourier transform, forming the frequency domain data set comprising:

an array of magnitude terms for frequency components from the Fourier transform of the source image, and an array of phase terms for frequency components from the Fourier transform of the source image;

manipulating by the processor at least one aspect of the frequency domain data set comprises the processor masking out terms from the array of phase terms for frequency components from the Fourier transform of the source image exhibiting a predetermined characteristic to form a manipulated frequency domain data set;

transforming by the processor the manipulated frequency domain data set into an image domain data set; and producing an image file for controlling operation of a multi-pixel lighting device, based at least in part on the image domain data set.

* * * * *